US006876320B2

(12) United States Patent
Puente Baliarda

(10) Patent No.: US 6,876,320 B2
(45) Date of Patent: Apr. 5, 2005

(54) ANTI-RADAR SPACE-FILLING AND/OR MULTILEVEL CHAFF DISPERSERS

(75) Inventor: Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 2 days.

(21) Appl. No.: 10/305,788

(22) Filed: Nov. 26, 2002

(65) Prior Publication Data

US 2003/0137442 A1 Jul. 24, 2003

(30) Foreign Application Priority Data

Nov. 30, 2001 (ES) ..... 200102675

(51) Int. Cl.[7] ..... H04K 3/00
(52) U.S. Cl. ..... 342/12; 342/5
(58) Field of Search ..... 342/5–20

(56) References Cited

U.S. PATENT DOCUMENTS

| | | | | |
|---|---|---|---|---|
| 3,521,284 A | | 7/1970 | Shelton, Jr. et al. | |
| 3,599,214 A | | 8/1971 | Altmayer | |
| 3,622,890 A | | 11/1971 | Fujimoto et al. | |
| 3,683,376 A | | 8/1972 | Pronovost | |
| 3,910,189 A | * | 10/1975 | Whidden et al. | 342/12 |
| 3,967,276 A | | 6/1976 | Goubau | |
| 3,969,730 A | | 7/1976 | Fuchser | |
| 4,024,542 A | | 5/1977 | Ikawa et al. | |
| 4,131,893 A | | 12/1978 | Munson et al. | |
| 4,167,009 A | * | 9/1979 | Schwartz | 342/12 |

(Continued)

FOREIGN PATENT DOCUMENTS

| | | |
|---|---|---|
| DE | 3337941 | 5/1985 |
| EP | 0096847 | 12/1983 |
| EP | 0543645 | 5/1993 |
| EP | 0571124 | 11/1993 |
| EP | 0765001 | 3/1997 |
| EP | 0814536 | 12/1997 |
| EP | 0892459 | 1/1999 |
| EP | 0932219 | 7/1999 |
| EP | 0997974 | 5/2000 |
| EP | 1018777 | 7/2000 |
| EP | 1018779 | 7/2000 |
| EP | 1079462 | 2/2001 |
| EP | 1083624 | 3/2001 |
| EP | 1094545 | 4/2001 |
| EP | 1096602 | 5/2001 |
| EP | 1267438 | 12/2002 |
| ES | 2112163 | 3/1998 |
| FR | 1604757 | 1/1972 |
| GB | 2215136 | 9/1989 |
| GB | 2330951 | 5/1999 |
| GB | 2355116 | 4/2001 |
| JP | 55147806 | 11/1980 |
| JP | 5007109 | 1/1993 |

(Continued)

OTHER PUBLICATIONS

Ali, M. et al., "A Triple–Band Internal Antenna for Mobile Hand–held Terminals," IEEE, pp. 32–35 (1992).

Romeu, Jordi et al., "A Three Dimensional Hilbert Antenna," IEEE, pp. 550–553 (2002).

Parker et al., "Microwaves, Antennas & Propagation," IEEE Proceedings H, pp. 19–22 (Feb. 1991).

European Patent Office Communication from the corresponding European patent application dated Dec. 23, 2003 (3 pgs.).

*Primary Examiner*—Bernarr E. Gregory
(74) *Attorney, Agent, or Firm*—Jones Day

(57) ABSTRACT

The present invention consists of the particular geometry of the reflectors or dispersers which constitute the anti-radar chaff cloud. Instead of using conventional rectilinear forms, in the present invention multilevel and space-filling forms are introduced. Due to this geometric design, the properties of the radar chaff clouds improve mainly in two aspects: radar cross-section (RCS) and mean time of suspension.

22 Claims, 22 Drawing Sheets

U.S. PATENT DOCUMENTS

| | | | | | |
|---|---|---|---|---|---|
| 4,471,358 | A | | 9/1984 | Glasser | |
| 4,471,493 | A | | 9/1984 | Schober | |
| 4,504,834 | A | | 3/1985 | Garay et al. | |
| 4,543,581 | A | | 9/1985 | Nemet | |
| 4,571,595 | A | | 2/1986 | Phillips et al. | |
| 4,584,709 | A | | 4/1986 | Kneisel et al. | |
| 4,590,614 | A | | 5/1986 | Erat | |
| 4,638,316 | A | * | 1/1987 | Austin et al. | 342/14 |
| 4,730,195 | A | | 3/1988 | Phillips et al. | |
| 4,839,660 | A | | 6/1989 | Hadzoglou | |
| 4,847,629 | A | | 7/1989 | Shimazaki | |
| 4,857,939 | A | | 8/1989 | Shimazaki | |
| 4,890,114 | A | | 12/1989 | Egashira | |
| 4,894,663 | A | | 1/1990 | Urbish et al. | |
| 4,975,711 | A | | 12/1990 | Lee | |
| 5,030,963 | A | | 7/1991 | Tadama | |
| 5,138,328 | A | | 8/1992 | Zibrik et al. | |
| 5,200,756 | A | | 4/1993 | Feller | |
| 5,212,488 | A | * | 5/1993 | Konotchick | 342/12 |
| 5,214,434 | A | | 5/1993 | Hsu | |
| 5,218,370 | A | | 6/1993 | Blaese | |
| 5,227,804 | A | | 7/1993 | Oda | |
| 5,227,808 | A | | 7/1993 | Davis | |
| 5,245,350 | A | | 9/1993 | Sroka | |
| 5,257,032 | A | | 10/1993 | Diamond et al. | |
| 5,347,291 | A | | 9/1994 | Moore | |
| 5,373,300 | A | | 12/1994 | Jenness et al. | |
| 5,420,599 | A | | 5/1995 | Erkocevic | |
| 5,422,651 | A | | 6/1995 | Chang | |
| 5,451,965 | A | | 9/1995 | Matsumoto | |
| 5,451,968 | A | | 9/1995 | Emery | |
| 5,457,469 | A | | 10/1995 | Diamond et al. | |
| 5,493,702 | A | | 2/1996 | Crowley et al. | |
| H1631 | H | | 2/1997 | Montgomery et al. | |
| 5,619,205 | A | * | 4/1997 | Johnson | 342/12 |
| 5,684,672 | A | | 11/1997 | Karidis et al. | |
| 5,767,811 | A | | 6/1998 | Mandai et al. | |
| 5,821,907 | A | | 10/1998 | Zhu et al. | |
| 5,841,403 | A | | 11/1998 | West | |
| 5,870,066 | A | | 2/1999 | Asakura et al. | |
| 5,872,546 | A | | 2/1999 | Ihara et al. | |
| 5,898,404 | A | | 4/1999 | Jou | |
| 5,903,240 | A | | 5/1999 | Kawahata et al. | |
| 5,943,020 | A | | 8/1999 | Liebendoerfer et al. | |
| 5,966,098 | A | | 10/1999 | Qi et al. | |
| 5,973,651 | A | | 10/1999 | Suesada et al. | |
| 5,990,838 | A | | 11/1999 | Burns et al. | |
| 6,002,367 | A | | 12/1999 | Engblom et al. | |
| 6,028,568 | A | | 2/2000 | Asakura et al. | |
| 6,031,505 | A | | 2/2000 | Qi et al. | |
| 6,104,349 | A | | 8/2000 | Cohen | |
| 6,127,977 | A | | 10/2000 | Cohen | |
| 6,140,975 | A | | 10/2000 | Cohen | |
| 6,218,992 | B1 | | 4/2001 | Sadler et al. | |
| 6,329,951 | B1 | | 12/2001 | Wen et al. | |
| 6,329,954 | B1 | | 12/2001 | Fuchs et al. | |
| 6,407,710 | B2 | | 6/2002 | Keilen et al. | |
| 6,445,352 | B1 | | 9/2002 | Cohen | |
| 6,452,549 | B1 | | 9/2002 | Lo | |
| 6,452,553 | B1 | | 9/2002 | Cohen | |
| 6,476,766 | B1 | | 11/2002 | Cohen | |
| 2002/0109633 | A1 | | 8/2002 | Ow et al. | |

FOREIGN PATENT DOCUMENTS

| | | |
|---|---|---|
| JP | 5129816 | 5/1993 |
| JP | 5267916 | 10/1993 |
| JP | 5347507 | 12/1993 |
| JP | 6204908 | 7/1994 |
| WO | 9638881 | 12/1996 |
| WO | 9706578 | 2/1997 |
| WO | 9733338 | 9/1997 |
| WO | 9747054 | 12/1997 |
| WO | 9812771 | 3/1998 |
| WO | 9903166 | 1/1999 |
| WO | 9903167 | 1/1999 |
| WO | 9925042 | 5/1999 |
| WO | 9956345 | 11/1999 |
| WO | 0001028 | 1/2000 |
| WO | 0003453 | 1/2000 |
| WO | 0022695 | 4/2000 |
| WO | 0052787 | 9/2000 |
| WO | 0103238 | 1/2001 |
| WO | 0108257 | 2/2001 |
| WO | 0113464 | 2/2001 |
| WO | 0117064 | 3/2001 |
| WO | 0124314 | 4/2001 |
| WO | 0126182 | 4/2001 |
| WO | 0128035 | 4/2001 |
| WO | 0131739 | 5/2001 |
| WO | 0133665 | 5/2001 |
| WO | 0135491 | 5/2001 |
| WO | 0137369 | 5/2001 |
| WO | 0137370 | 5/2001 |
| WO | 0141252 | 6/2001 |
| WO | 0154225 | 7/2001 |
| WO | 0178192 | 10/2001 |
| WO | 02091518 | 11/2002 |
| WO | 02096166 | 11/2002 |

* cited by examiner

ANTI-RADAR SPACE-FILLING AND/OR MULTILEVEL CHAFF DISPERSERS

This application claims priority to Spanish patent application serial no. 200102675 filed Nov. 30, 2001. By this reference, the full disclosure, including the drawings, of this Spanish patent application is incorporated herein.

OBJECT AND BACKGROUND OF THE INVENTION

Chaff was one in the first forms of countermeasure employed against radar. It usually consists of a large number of electromagnetic dispersers and reflectors, normally arranged in form of strips of metal foil packed in a bundle. When they are released by an aircraft or distributed by rockets launched by a ship, most of the strips of foil which constitute the chaff bale are dispersed by the effect of the wind and become highly reflective clouds.

Chaff is a relatively slow target. Its vertical descent is determined by the force of gravity and for the properties to resist advance presented by the strips of individual leaves. Chaff was a very effective countermeasure when using slow bomber aircraft during the Second World War. Chaff is usually employed to foil or to confuse surveillance and tracking radar. Miscellaneous reference information on radar chaff can be found in M. I. Skolnik's "Introduction to Radar Systems", McGraw-Hill, London, 1981.

To date various inventions related with chaff have already been presented. Many of them are related with the distribution and ejection of chaff (see for example the patents with publication numbers EP0246368, EP0036239, EP0036239, U.S. Pat. No. 4,597,332, U.S. Pat. No. 4,471,358, U.S. Pat. No. 5,835,682) or with the materials and composition used in the reflectors and dispersion particles (see for example the patents with publication number U.S. Pat. No. 5,087,515, U.S. Pat. No. 4,976,828, U.S. Pat. No. 4,763,127, U.S. Pat. No. 4,600,642, U.S. Pat. No. 3,952,307, U.S. Pat. No, 3,725,927). Nevertheless, little attention has been paid to the design of the shape of the dispersers which form the cloud. A design for a disperser in sword form is described in the Patent GB2215136, which provides a way whereby the dispersers descend rotating by the effect of gravity, facilitating a complex radar cross-section (RCS) which can confuse systems with Doppler radar.

The heart of the present invention lies in the geometry of the dispersers or reflectors which improve the properties of radar chaff.

Some of the geometries employed in the present invention are already related with some forms expounded for antennas. Multilevel and space-filling antennas are distinguished in being of reduced size and having a multiband behaviour, as has been expounded already in patent publications WO0154225 and WO0122528, respectively.

Nevertheless, it is to be stressed that the dispersers used in the present invention are not antennas, and that the features required of antennas are different with regard to those required by radar chaff. Antennas are used to transmit and receive associated signals to or from a transceiver by means of a transmission line or a radio frequency network.

Also, antennas are composed of several parts, like the radiating elements, the ground planes or ground references, as well as connectors for input and output terminals. The dispersers presented in the present invention are not used to receive or transmit signals and are not associated with any transceiver, nor do they comprise a assembly of complementary elements like ground planes, connectors, etc. The main technical characteristics sought in the design of an antenna are gain, radiation pattern and impedance. In radar chaff it makes no sense to design for gain or impedance, since dispersers have no terminal by which to define an impedance and, since they are not an instrument for receiving or transmitting, the gain parameter is of no sense. The main electrical characteristic of a radar chaff disperser is its radar cross-section (RCS) which is related with the reflective capability of the disperser, and which cannot be anticipated by the characteristic parameters of the antennas. The chaff dispersers expounded in the present invention are mainly electromagnetic reflectors constituted of a conducting, semiconducting or superconducting material with a new geometry which improves the properties of the chaff. The new geometry facilitates a large RCS compared with dispersers presented in previous inventions having the same size; surprisingly the RCS is equivalent to that of conventional dispersers of greater size.

A review of the state of the art in radar chaff reveals totally different geometries for chaff dispersers (mainly rectilinear strips and meshed fibres) which endeavour to resolve packaging density by means of the materials used in the chaff, mainly dielectric fibres with a fine metallic cladding. In the present invention, the distinctive sizes for the new geometry presented are combined with a type of surface which provides a better aerodynamic profile which permits an improvement in the suspension properties of the whole radar chaff cloud. Clearly, since the essence of the invention resides in the particular properties of reflection of the new geometries presented for the chaff dispersers, these new geometries are compatible and can be combined with any of the materials and manufacturing techniques described in the state of the art.

SUMMARY OF THE INVENTION

The essence of the invention consists of the particular geometry of the reflectors or dispersers which constitute the cloud of radar chaff. Instead of using conventional rectilinear forms, in the present invention multilevel and space-filling forms are introduced. Due to this geometric design, the properties of the clouds of radar chaff are improved mainly in two aspects: radar cross-section (RCS) and mean time of suspension.

It is to be stressed that, beyond the reflective response of the new dispersers presented for radar chaff, the benefit resulting from using these new geometries with regard to the state of the art is the aerodynamic profile thereof. Being highly complicated and irregular forms, the friction with the air is improved by improving the time of suspension with regard to the state of the art. This new effect is directly related with the new geometry presented and bears no relation with the electromagnetic behaviour of the disperser.

For the purpose of the present invention, a space-filling curve for a chaff disperser is defined as: a curve comprising at least ten segments which are connected so that each element forms an angle with its neighbours, no pair of these segments defines a longer straight segment, these segments being smaller than a tenth part of the resonant wavelength in free space of the entire structure of the disperser. In many of the configurations presented, the size of the entire disperser is smaller than a quarter of the lowest operating wavelength.

In no way limiting, FIGS. 1 to 12 show several examples of space-filling curves which can be used according to the present invention. The space-filling curves are long in terms of physical length but small in terms of area in which the curve can be included. The dispersers with space-filling form are long electrically but can be included in a very small surface area. This means it is possible to obtain a smaller packaging and a denser chaff cloud using this technique.

Another characteristic of the space-filling dispersers is their frequency response. Their complex geometry provides a spectrally richer signature when compared with rectilinear dispersers known in the state of the art. Non-harmonic frequency responses are obtained with pass-bands and stop-bands distributed unequally, which is of great utility when the intention is to improve the clutter effect of the chaff cloud over a wider margin of radar frequencies.

Depending on the process of the form and of the geometry of the curve, some space-filling curves (SFC) can be designed theoretically to characterise a larger Hausdorff dimension than their topological dimensions. Namely, in terms of Euclidean geometry. It is usually always understood that a curve is a one-dimensional object; nevertheless, when the curve is highly complex and its physical length is very large, the curve tends to fill part of the surface which comprises it; in this case the Hausdorff dimension can be calculated on the curve (or at least an approximation to this by means of the mathematical algorithm known as box-counting) giving a number larger than unity as a result. These infinite theoretical curves cannot be constructed physically, but they can be approximated with SFC designs. Curves 4 and 15 described in FIGS. 1 and 3 are some examples of these SFC, which approximate an ideal infinite curve with a characteristic dimension D=2.

The space-filling properties of SFC dispersers not only introduce an advantage in terms of reflected radar signal response, but also in terms of the aerodynamic profile of said dispersers. It is known that a surface offers greater resistance to air than a line or a one-dimensional form. Therefore, giving form to the dispersers with SFC with a dimension greater than unity (D>1), increases resistance to the air and improves the time of suspension. In the case of SFC with D approaching 2 (like for example the designs in FIG. 1 and FIG. 3), the surface-like behaviour is maximized, and for this reason a disperser is obtained which has a reflection response similar to a linear form, but which is smaller and at the same time is characterised in that it has a resistance to air proper to that of a surface. Although the improvement in time of suspension and resistance to advance are directly related with the geometry presented in the present invention, this effect is totally different to the electromagnetic one and it cannot be deduced or predicted from the electromagnetic properties of the dispersers.

Multilevel structures are a geometry related with space-filling curves. For the purpose of the present invention, a multilevel structure for radar chaff is defined as: a structure which includes a set of polygons, which are characterised in having the same number of sides, wherein these polygons are electromagnetically coupled either by means of capacitive coupling, or by means of an ohmic contact, where the region of contact between the directly connected polygons is smaller than 50% of the perimeter of the polygons mentioned in at least 75% of the polygons that constitute the defined multilevel structure. In a multilevel structure, the global geometry of the whole structure is different to the geometry of the polygons which form it.

In like manner to space-filling forms, multilevel structures provide both a reduction in the sizes of dispersers and an enhancement of their frequency response. The dispersers which are at least partially formed by multilevel structures will be smaller than those described in the state of the art, and they provided a better multiband response. Multilevel structures can resonate in a non-harmonic way, and can even cover simultaneously and with the same relative bandwidth at least a portion of numerous bands: HF, VHF, UHF, L, S, C, X, Ku, K, Ka and mm.

In like manner to space-filling forms, multilevel structures for radar chaff also provide a better aerodynamic profile with respect to chaff of the state of the art. Multilevel structures are characterised in having multiple holes between polygons, an irregular perimeter (for example an SFC perimeter) or a combination of both characteristics. When the dispersers are constructed with only one conducting material, this conducting material being constructed in multilevel structure form, said holes and the perimeter of both characteristics introduce turbulence in the air which changes the resistance to the advance of the disperser when compared with conventional dispersers used in non-multilevel structures. Also, the multiple holes on the interior of the multilevel structure introduce a reduction in the total of the conducting surface of the disperser, which means the disperser is lighter than conventional dispersers of the same sizes and enclosing the same solid area. Again this effect is related with the particular geometry expounded in the present invention, but it has no relation and cannot be predicted from the electromagnetic response or the behaviour of said structures.

Despite space-filling and multilevel structures for radar dispersers offering a similar electromagnetic response in terms of size reduction and multiband behaviour, space-filling structures are preferred when a reduction in size is required, while multilevel structures are preferred when it is required that the most important considerations be given to the spectral response of radar chaff.

The relationship between space-filling and multilevel structures for radar dispersers are not only given by their electromagnetic response but also by their geometry. Many of the multilevel structures are characterised in having a space-filling perimeter, at least on one side of said perimeter, while in some cases the interior holes of said multilevel structures have the form of space-filling curves.

The main advantages for configuring the form of the chaff dispersers according to the present invention are (although not limited by):

1) The dispersers are small, consequently more dispersers can be encapsulated in a same cartridge, rocket or launch vehicle. This means that the same device will provide a larger RCS with respect to chaff of the state of the art.
2) The dispersers are also lighter, therefore they can remain more time floating in the air than the conventional chaff.
3) Due to the smaller size of the chaff dispersers, the launching devices (cartridges, rockets, etc.) can be smaller with regard to chaff systems in the state of the art providing the same RCS.
4) Due to the lighter weight of the chaff dispersers, the launching devices can shoot the packages of chaff farther from the launching devices and locations.
5) Chaff constituted by multilevel and space-filling structures provide larger RCS at longer wavelengths than conventional chaff dispersers of the same size.
6) The dispersers with long wavelengths can be configured and printed on light dielectric supports having a non-aerodynamic form and opposing a greater resistance to the air and thereby having a longer time of suspension.

7) In a package of the state of the art of the same size, a greater number of disperser sizes can be included, increasing the spectral margin covered by the chaff cloud.

8) The dispersers provide a better frequency response with regard to dispersers of the state of the art, which signifies:
   a) A simple disperser can be designed to cover all frequency bands instead of using a disperser element for each band.
   b) A simple disperser can provide a larger bandwidth for each radar band due to its non-harmonic electromagnetic response.

BRIEF DESCRIPTION OF THE DRAWINGS

To complete the description being made and with the object of assisting in a better understanding of the characteristics of the invention, in accordance with a preferred example of practical embodiment thereof, this description is accompanied, as an integral part thereof, with a set of drawings wherein by way of illustration and not restrictively, the following has been represented.

DETAILED DESCRIPTION OF THE PREFERRED EMBODIMENTS

Those of ordinary skill in the art will recognize that the present invention can adopt the form of multiple configurations. Without limiting the purpose of the present invention, some particular embodiments are explained below of how this invention can be put into practice.

Different forms and geometries of space-filling and multilevel structures for chaff dispersers can be chosen depending on the necessary degree of miniaturization and frequency response. For a higher degree of miniaturization, it is preferred that the space-filling curves have a Hausdorff (box-counting) dimension D larger than one. Although other space-filling curves can be used like those which wind or coil (see for example (5) and (6) in FIG. 2), smaller dispersers can be obtained for the same radar frequency when said space-filling curves have a dimension D larger than one. In general, the larger the box-counting dimension, the smaller will be the disperser for the same resonant frequency. For a planar chaff disperser, space-filling curves having dimension D of 2, provide the best compression ratio. In FIGS. 1, 2, 3, 6 and 9 (drawings (2), (3), (4), (7), (8), (10), (11), (12), (15), (26), (27), (28), (36), (37), (38), (39)) examples of space-filling curves are shown (like that of Hilbert, SZ, Peano and that of HilbertZZ), the dimension D of which is close to 2.

Because the Hausdorff dimension is a parameter difficult to measure in practical designs, it is preferred to use the box-counting dimension. The box-counting algorithm is a very well-known mathematical procedure for calculating an approximation to the Hausdorff dimension. It consists basically of overlapping several meshes with different sizes on a design or pattern, and counting the number of boxes of the mesh which includes at least a part of the design or pattern. When the scale of the boxes of the mesh and the number of boxes counted included in the pattern is represented in a log-log graph, the resulting gradient of the curve gives the aforementioned box-counting dimension for said design or pattern. For the purpose of said invention, some preferred configurations of space-filling curves show a box-counting dimension larger than unity, at least over a portion of the curve (an octave on the horizontal axis) used in the log-log graph.

Figure 17:
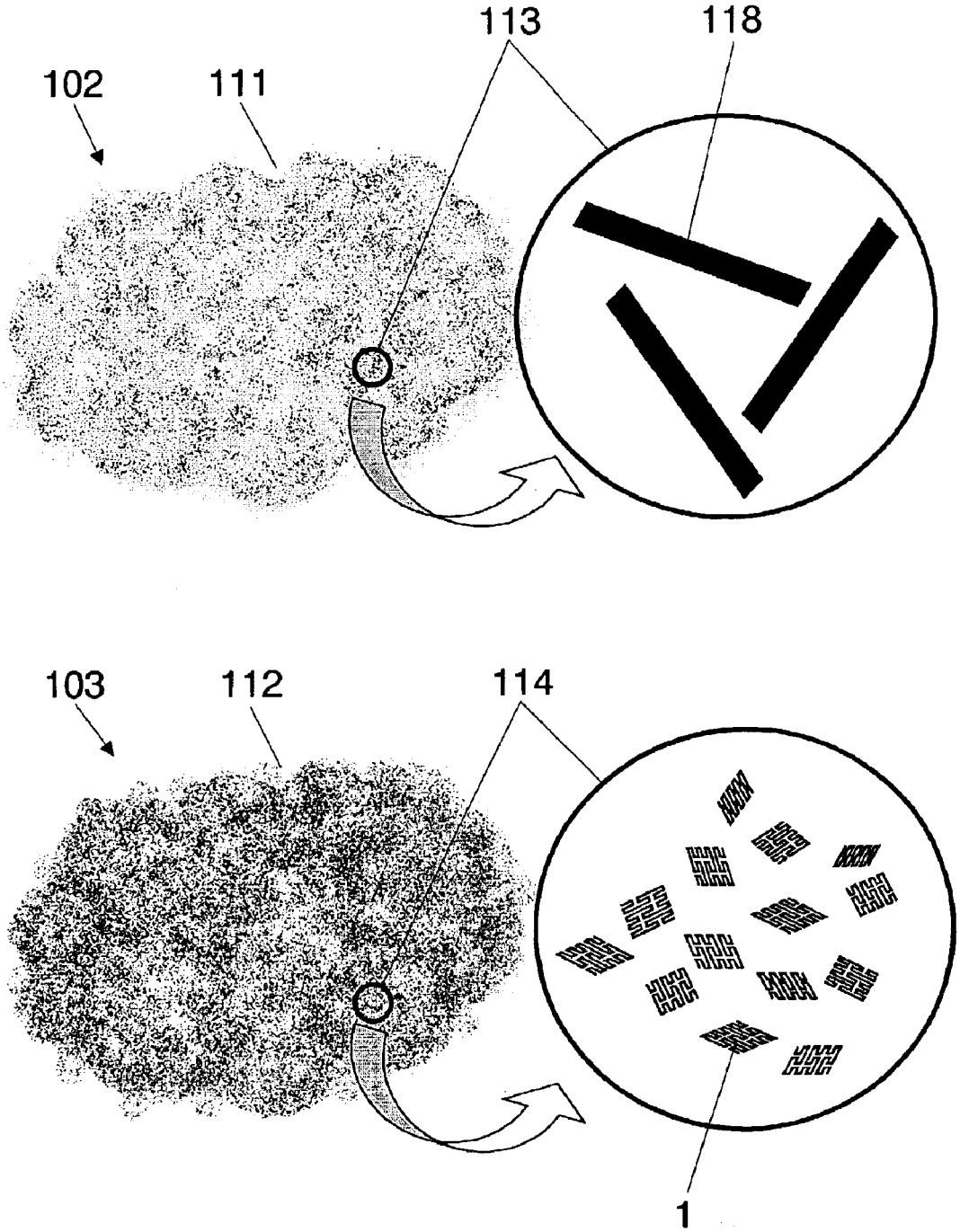
FIG. 17 shows a comparison between a conventional chaff cloud with regard to a multilevel or space-filling chaff cloud in accordance with the present invention.

In FIG. 17 a comparison is shown of a conventional radar chaff cloud (111) formed by long strips of dispersers (118) with a denser radar chaff cloud (112) which is obtained using space-filling dispersers (1) like those shown in the present invention.

Figure 1:
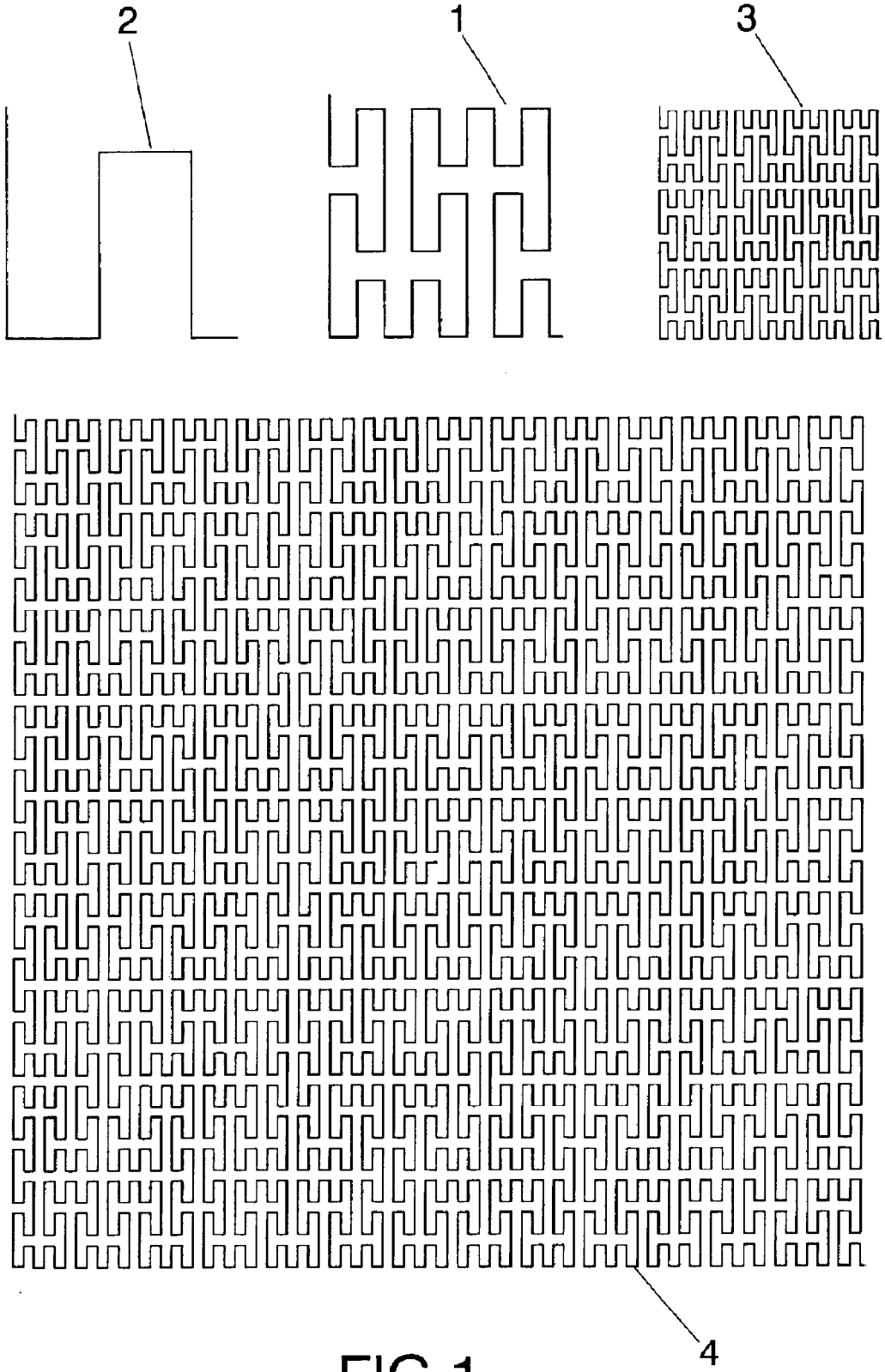
FIG. 1 shows three examples of SZ space-filling curves which can be used to configure the chaff dispersers in accordance with the present invention.
Figure 2:
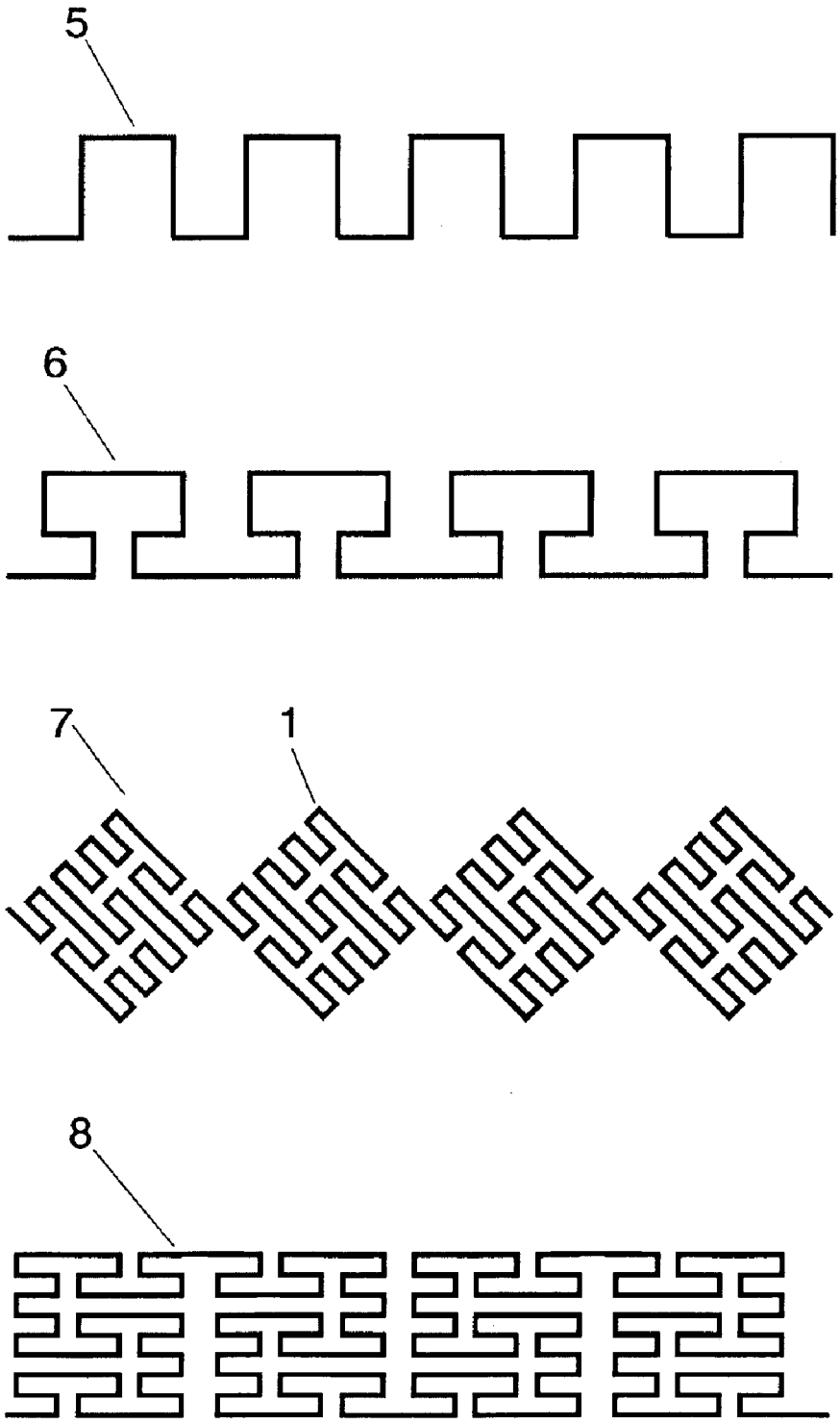
FIG. 2 shows four examples of space-filling curves in accordance with the present invention.
Figure 3:
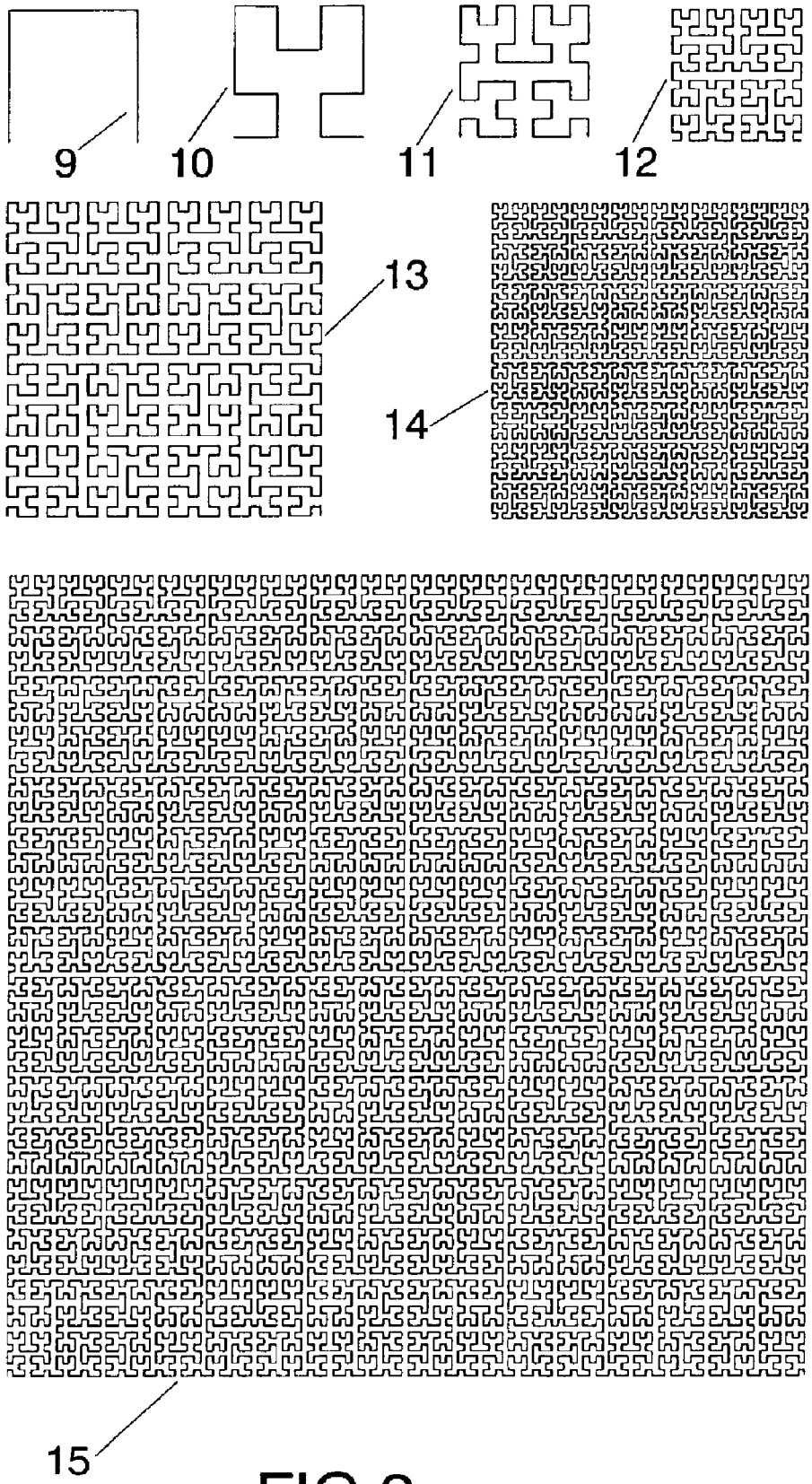
FIG. 3 shows several examples of Hilbert space-filling curves which can be used to configure the chaff dispersers in accordance with the present invention.
Figure 4:
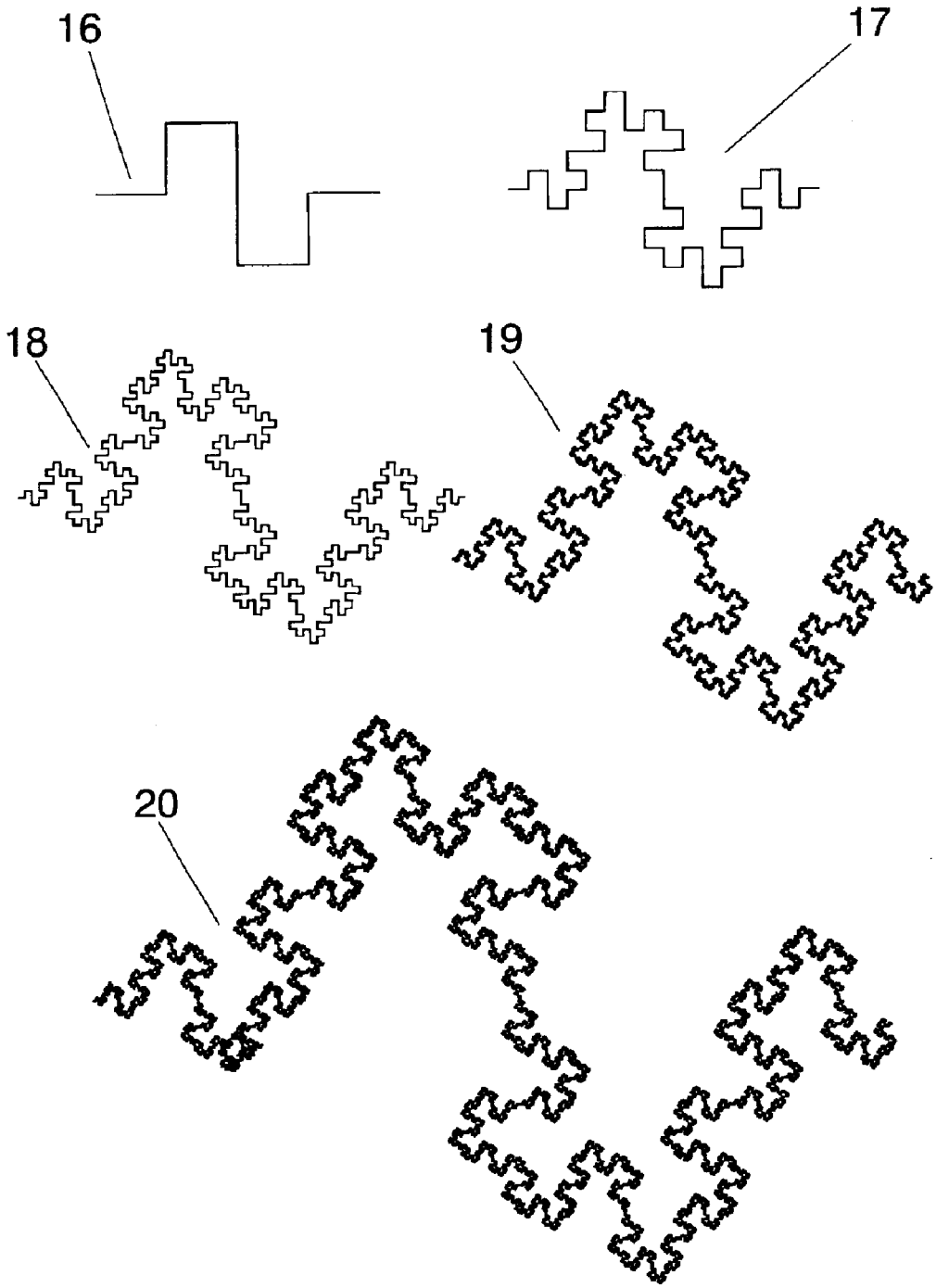
FIG. 4 shows various examples of ZZ space-filling curves which can be used to configure the chaff dispersers in accordance with the present invention.
Figure 5:
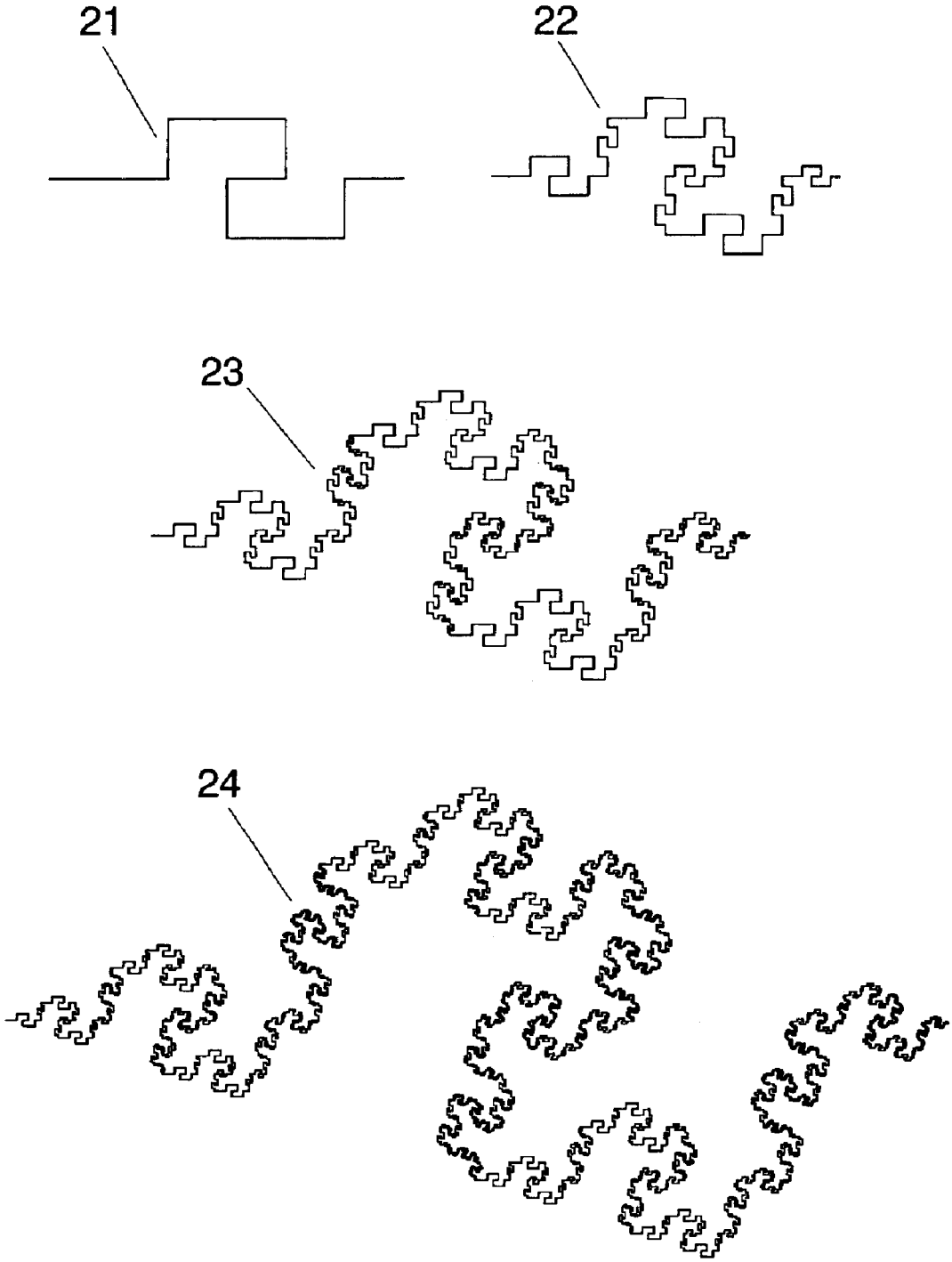
FIG. 5 shows several examples of space-filling curves which can be used to configure chaff dispersers in accordance with the present invention.
Figure 6:
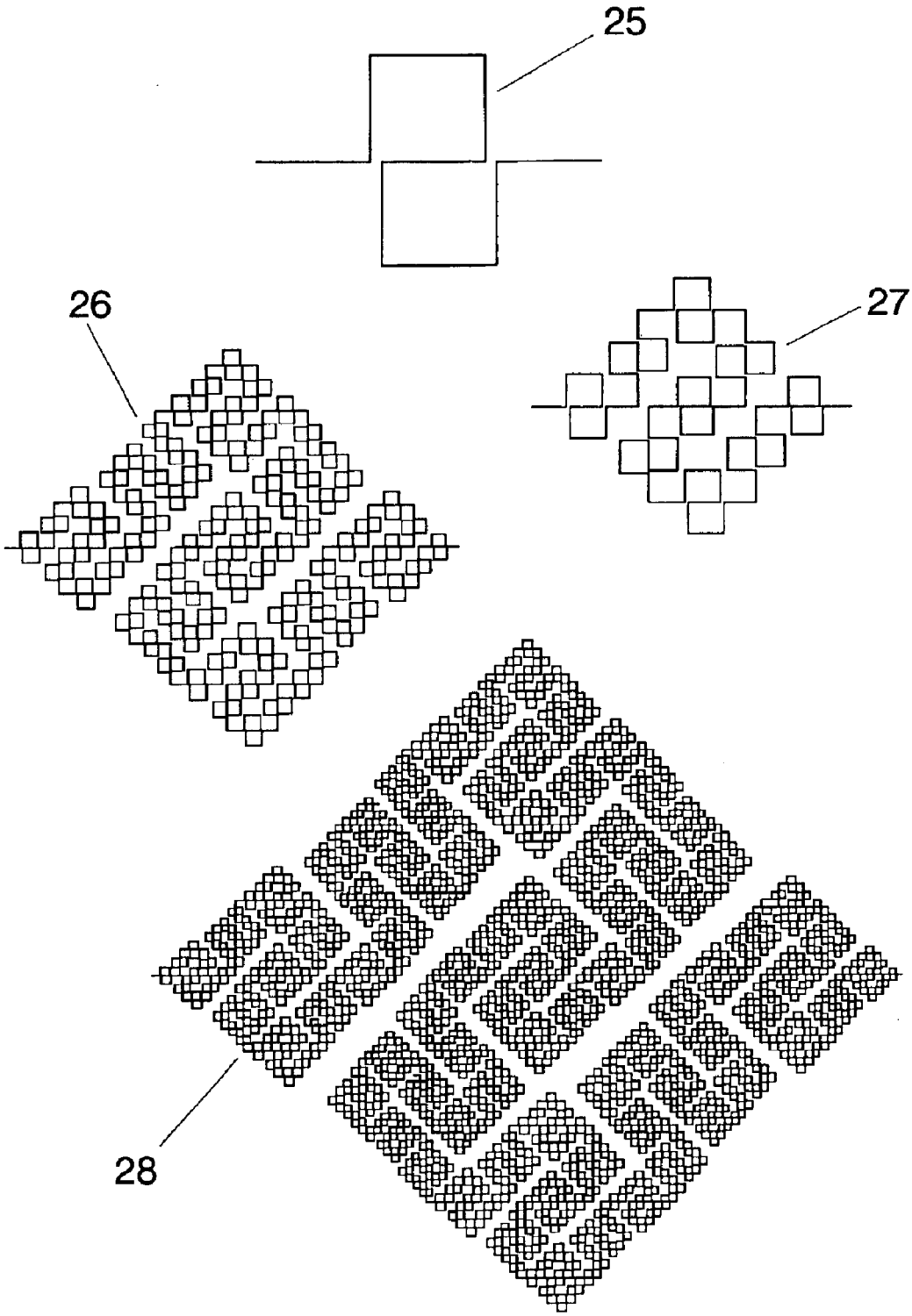
FIG. 6 shows several examples of Peano space-filling curves which can be used to configure chaff dispersers in accordance with the present invention.
Figure 7:
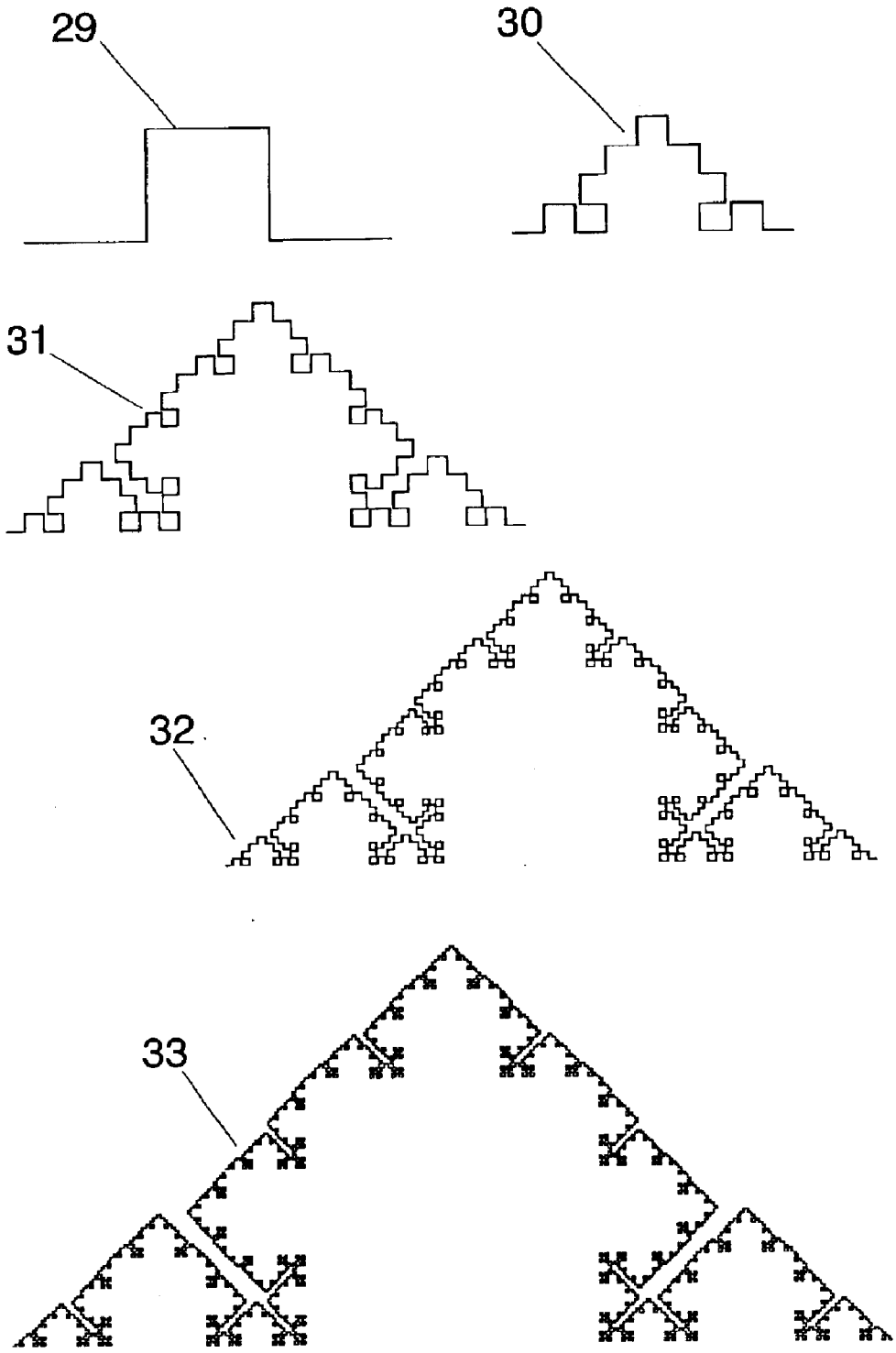
FIG. 7 shows several examples of space-filling curves which can be used to configure chaff dispersers in accordance with the present invention.
Figure 8:
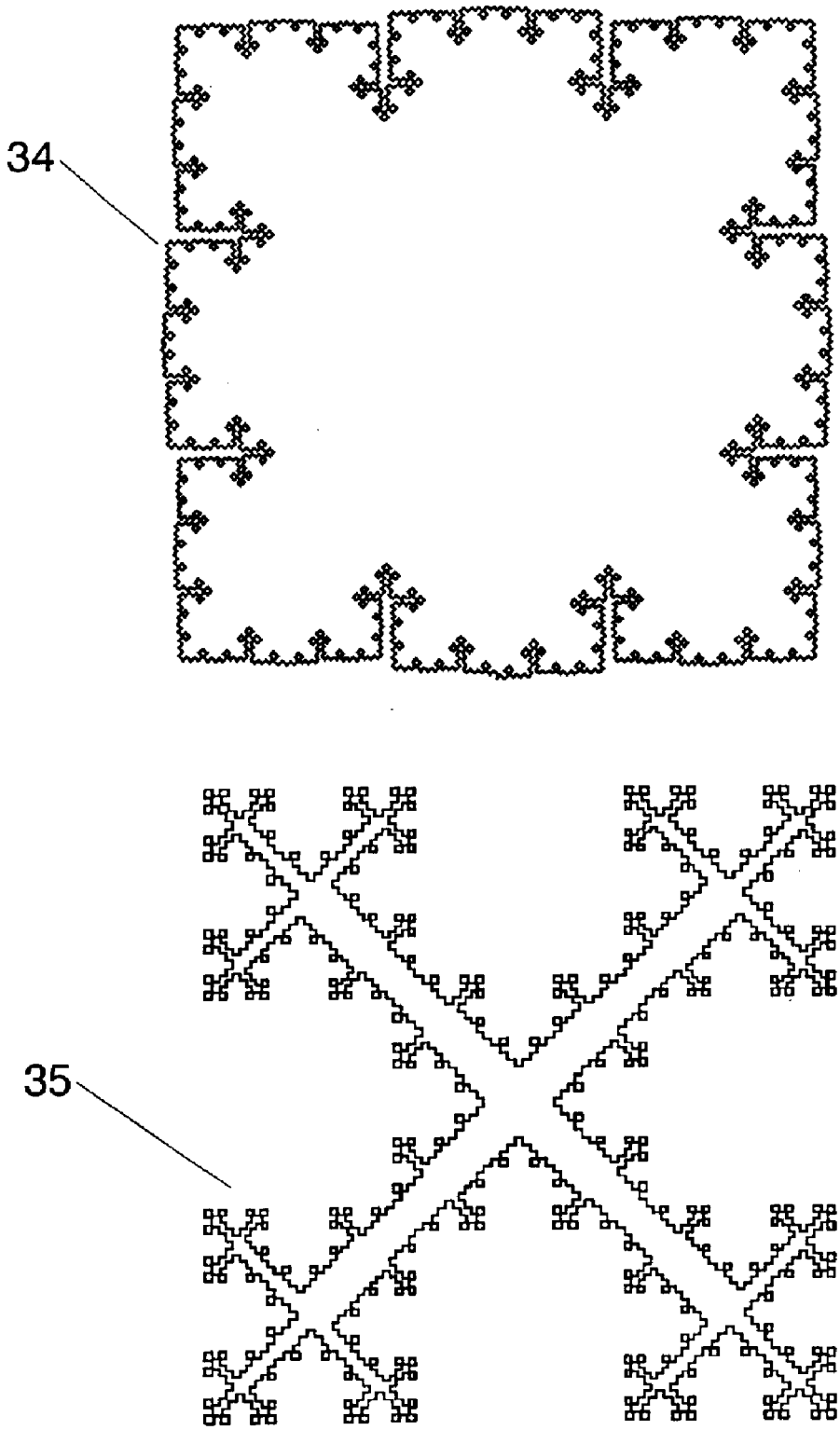
FIG. 8 shows two examples of space-filling curves which define a loop which can be used to configure chaff dispersers in accordance with the present invention.
Figure 9:
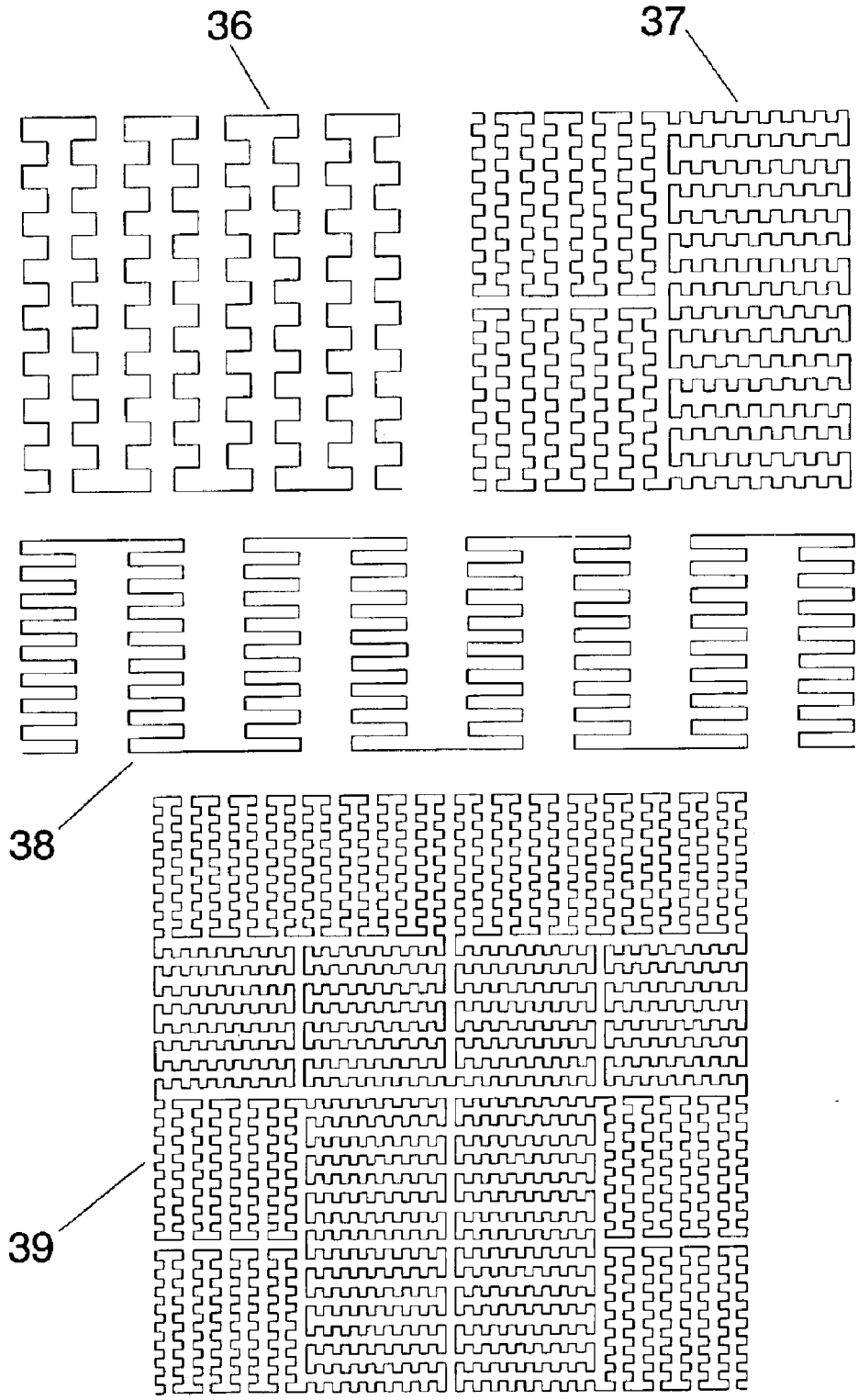
FIG. 9 shows two examples of Hilbert ZZ space-filling curves which define a loop which can be used to configure chaff dispersers in accordance with the present invention.
Figure 10:
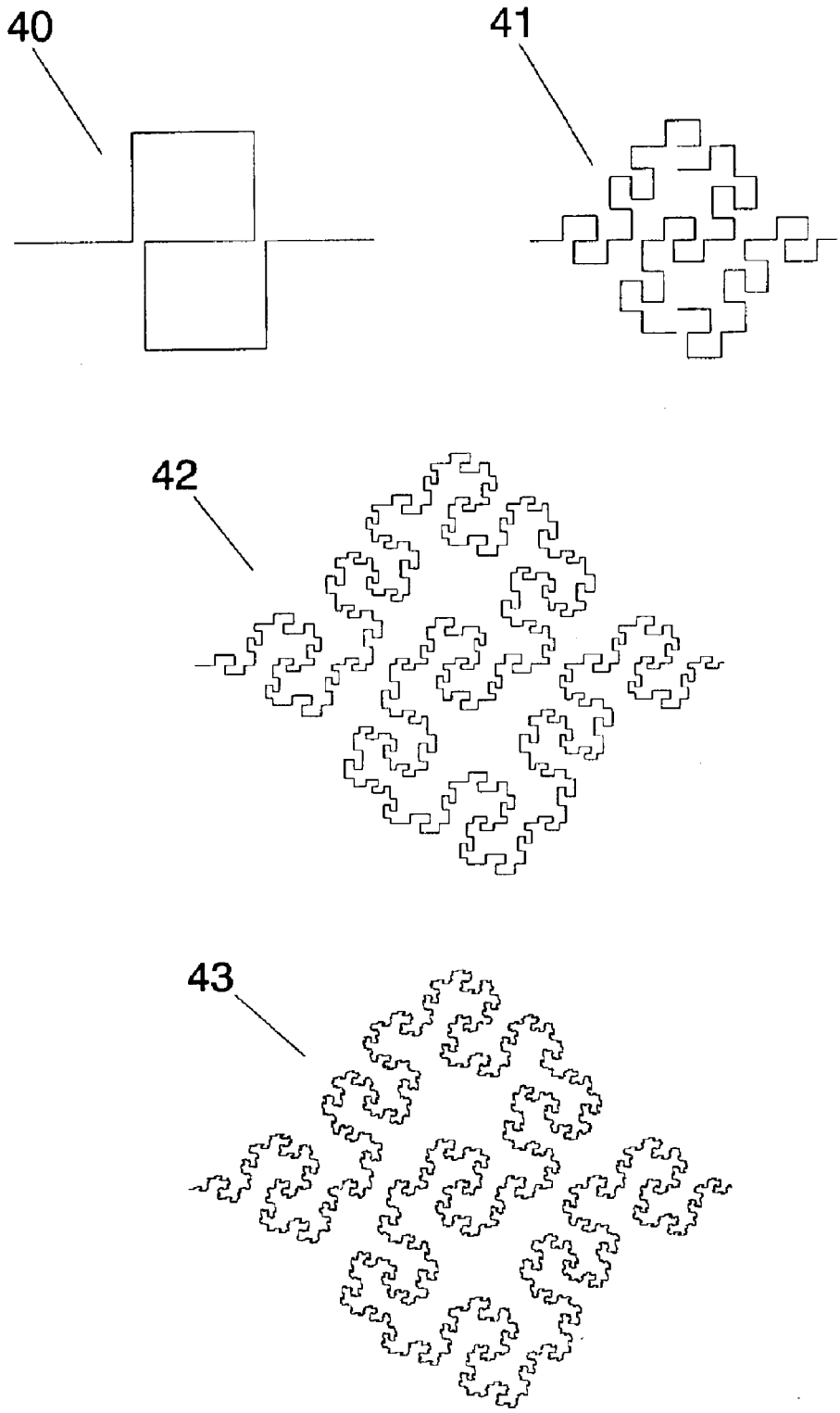
FIG. 10 shows several examples of Peanodec space-filling curves which can be used to configure chaff dispersers in accordance with the present invention.
Figure 11:
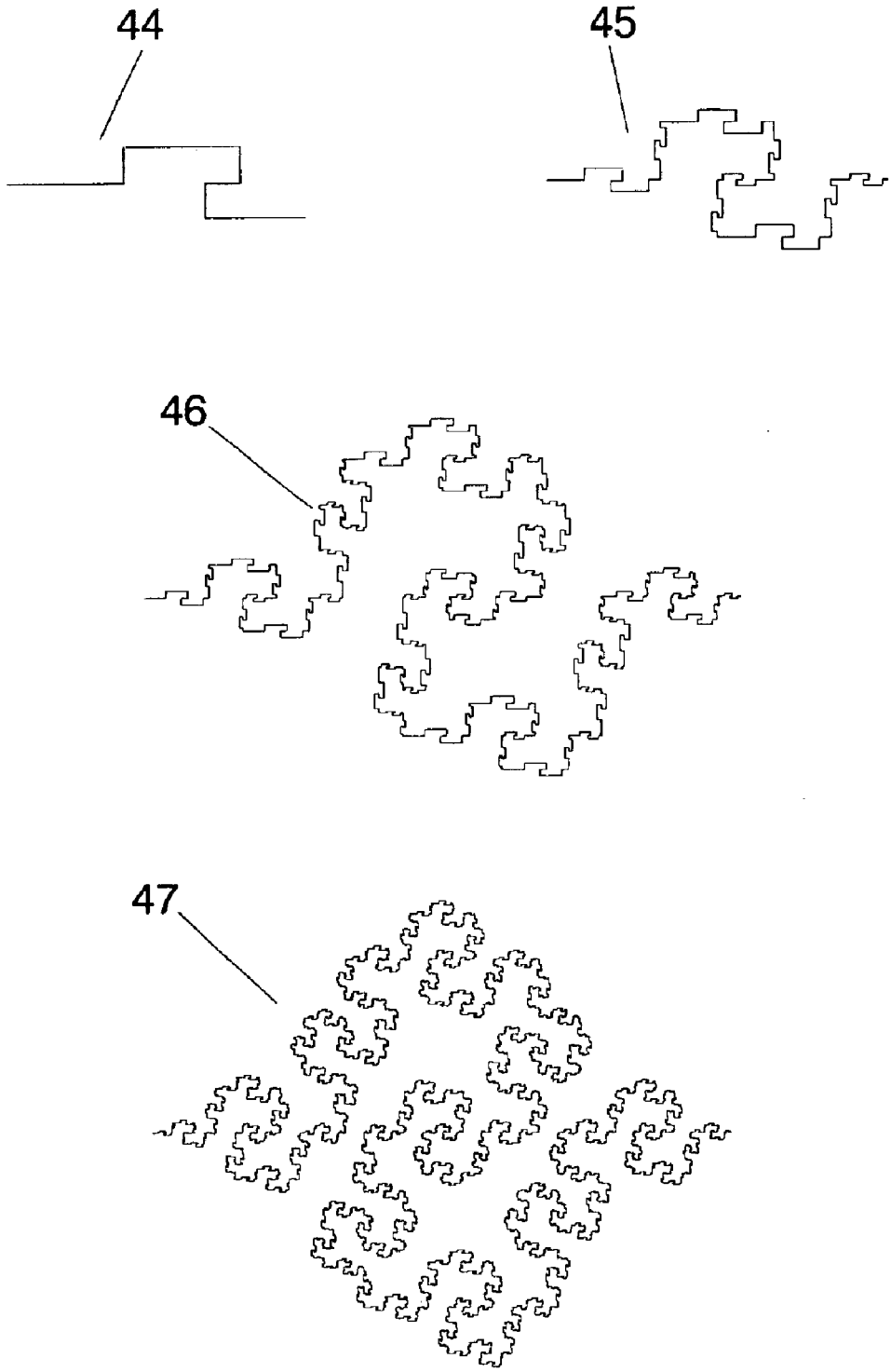
FIG. 11 shows several examples of Peanoinc space-filling curves which can be used to configure chaff dispersers in accordance with the present invention.
Figure 12:
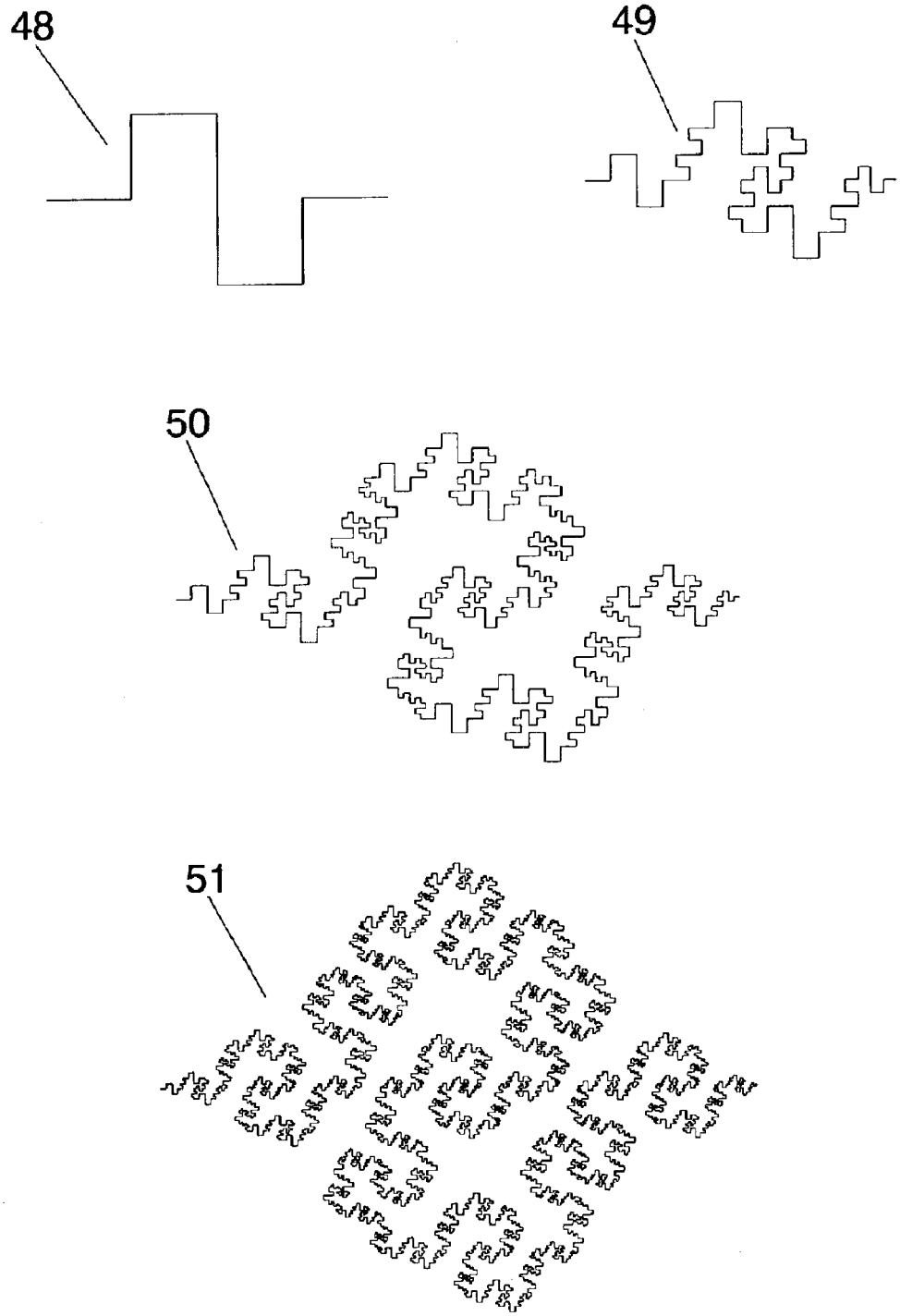
FIG. 12 shows several examples of Peano ZZ space-filling curves which can be used to configure chaff dispersers in accordance with the present invention.
Figure 13:
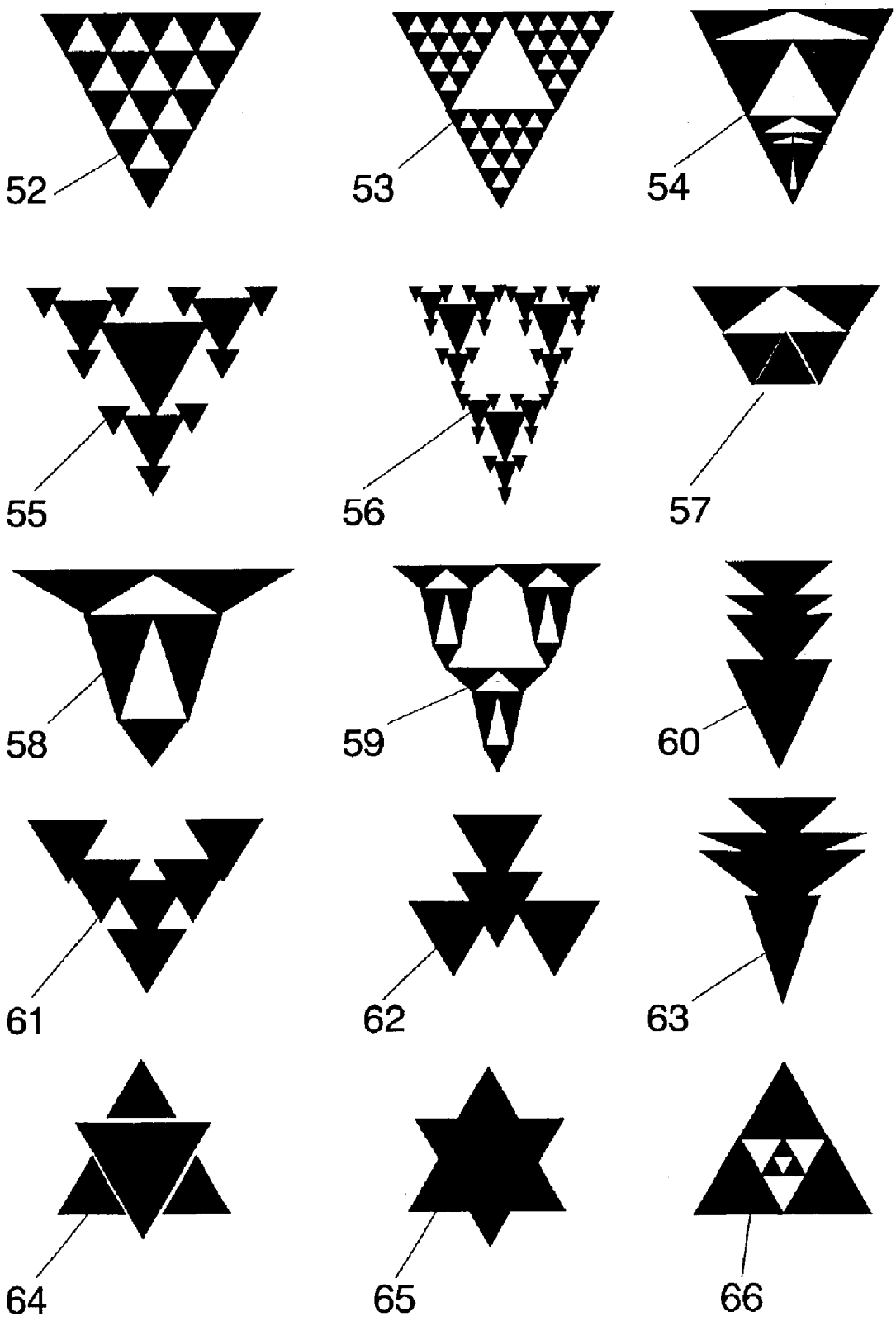
FIG. 13 shows several examples of multilevel structures built by joining various types of triangles.
Figure 14:
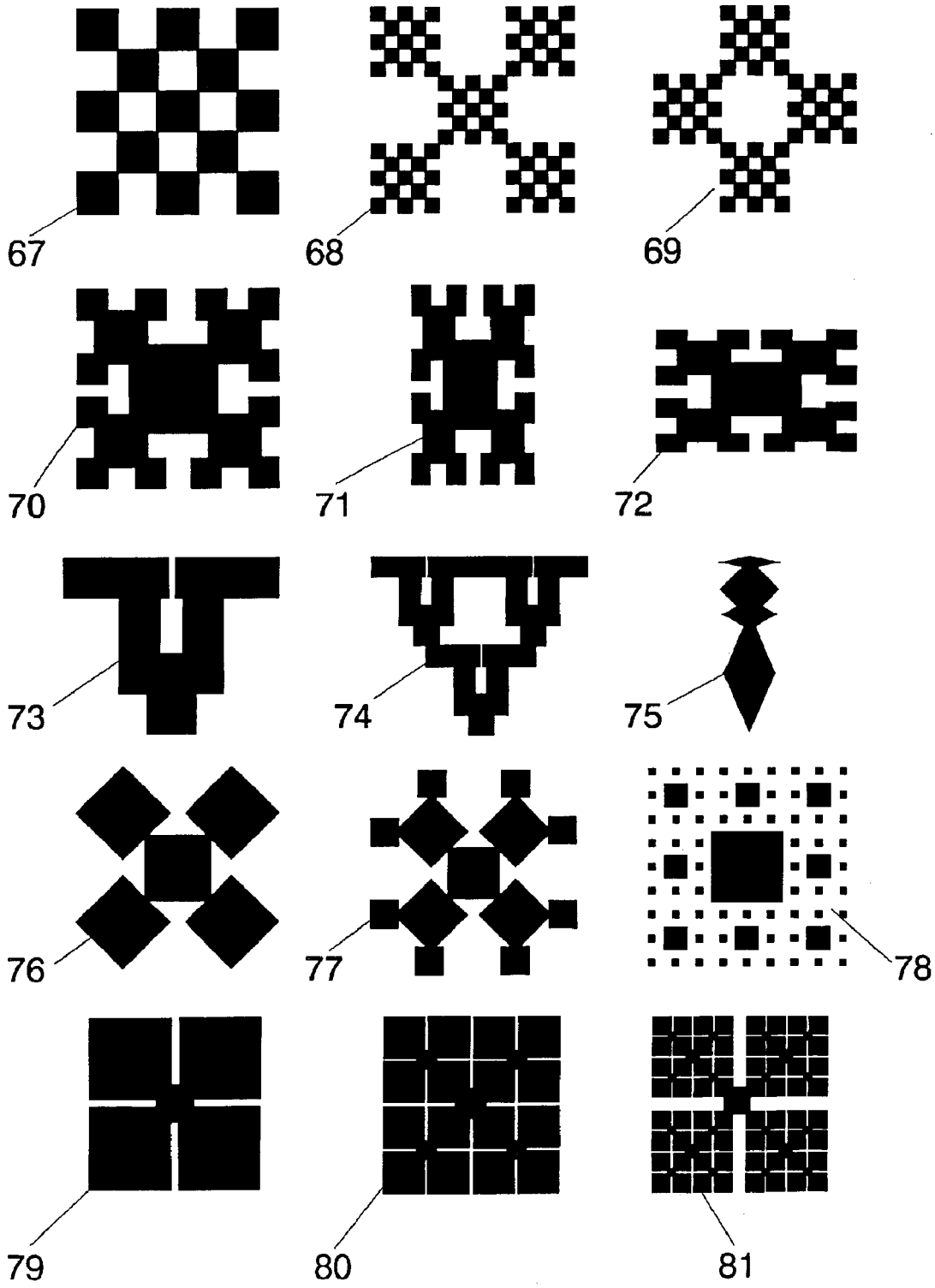
FIG. 14 shows several examples of multilevel structures built joining various types of squares.
Figure 18:
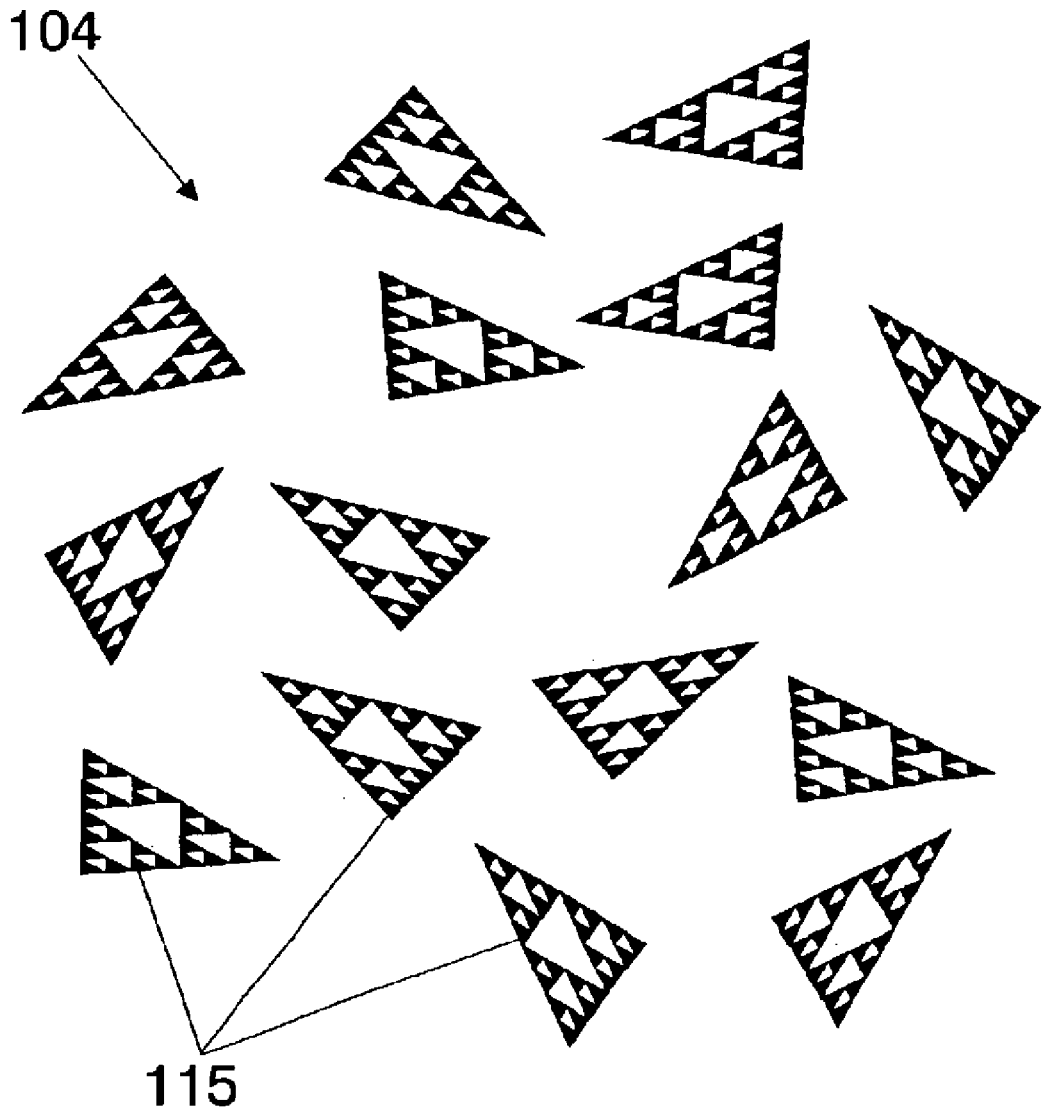
FIG. 18 shows some multilevel dispersers forming a chaff cloud in accordance with the present invention.
Figure 19:
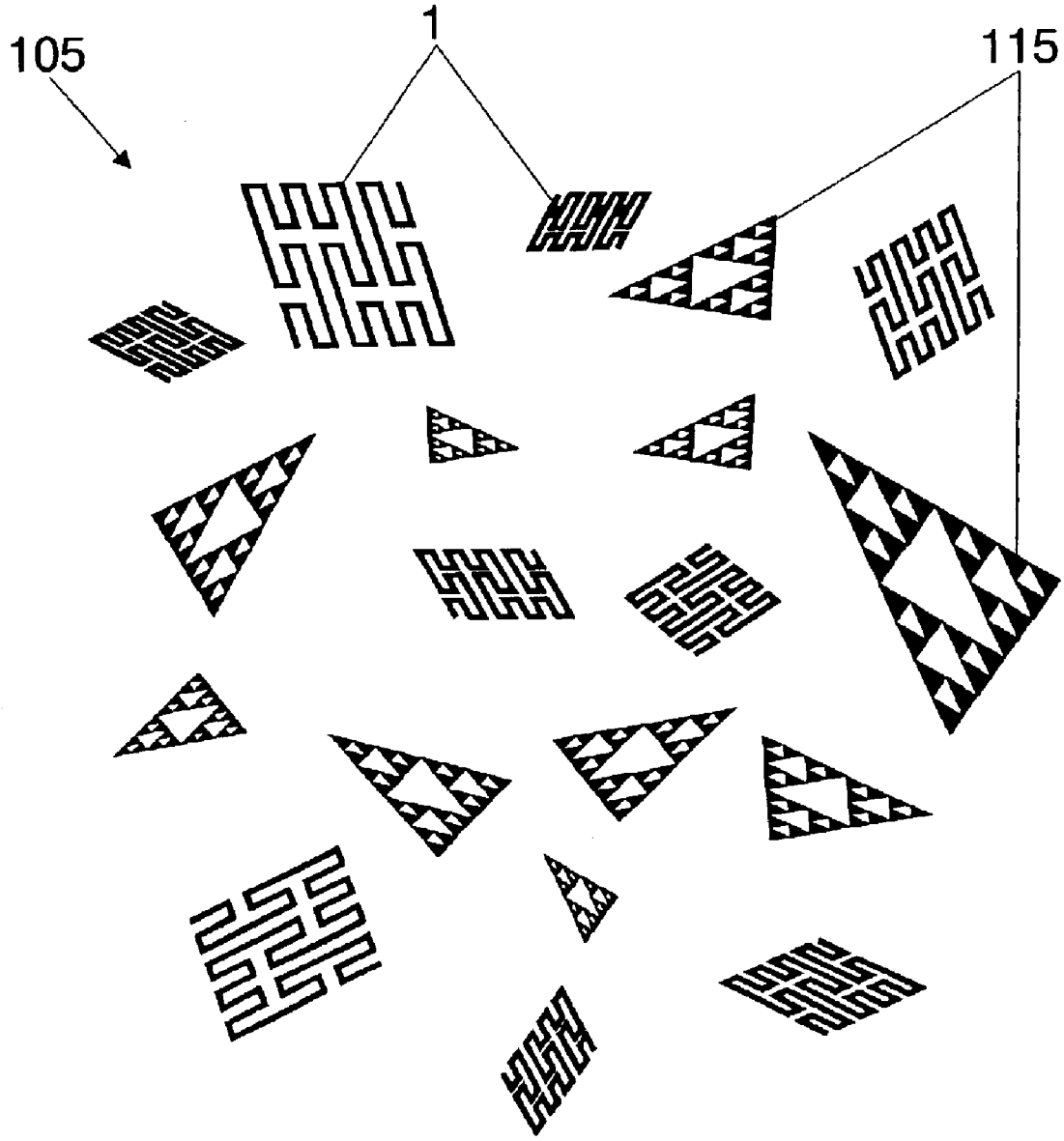
FIG. 19 shows a mix of multilevel and space-filling structures with diverse sizes forming a radar cloud in accordance with the present invention.

FIGS. 13 and 14 show several examples of multilevel structures which can be used to model radar chaff dispersers in accordance with the present invention. Similarly to space-filling forms, multilevel structures are also characterised by a reduction in size with respect to conventional geometries. But the main benefit of said structures is their good frequency response which allows the dispersers to provide a larger RCS simultaneously in several radar frequency bands. This also means that a reduction in packaging is obtained since the individual dispersers can replace many single-band dispersers, each disperser operating at a particular radar frequency. An example of radar chaff cloud which uses this type of disperser is shown in FIG. 18, while a cloud of radar chaff which contains a mix of space-filling and multilevel geometries of different sizes and geometries is described, in no way limiting the proposal in FIG. 19.

Figure 15:
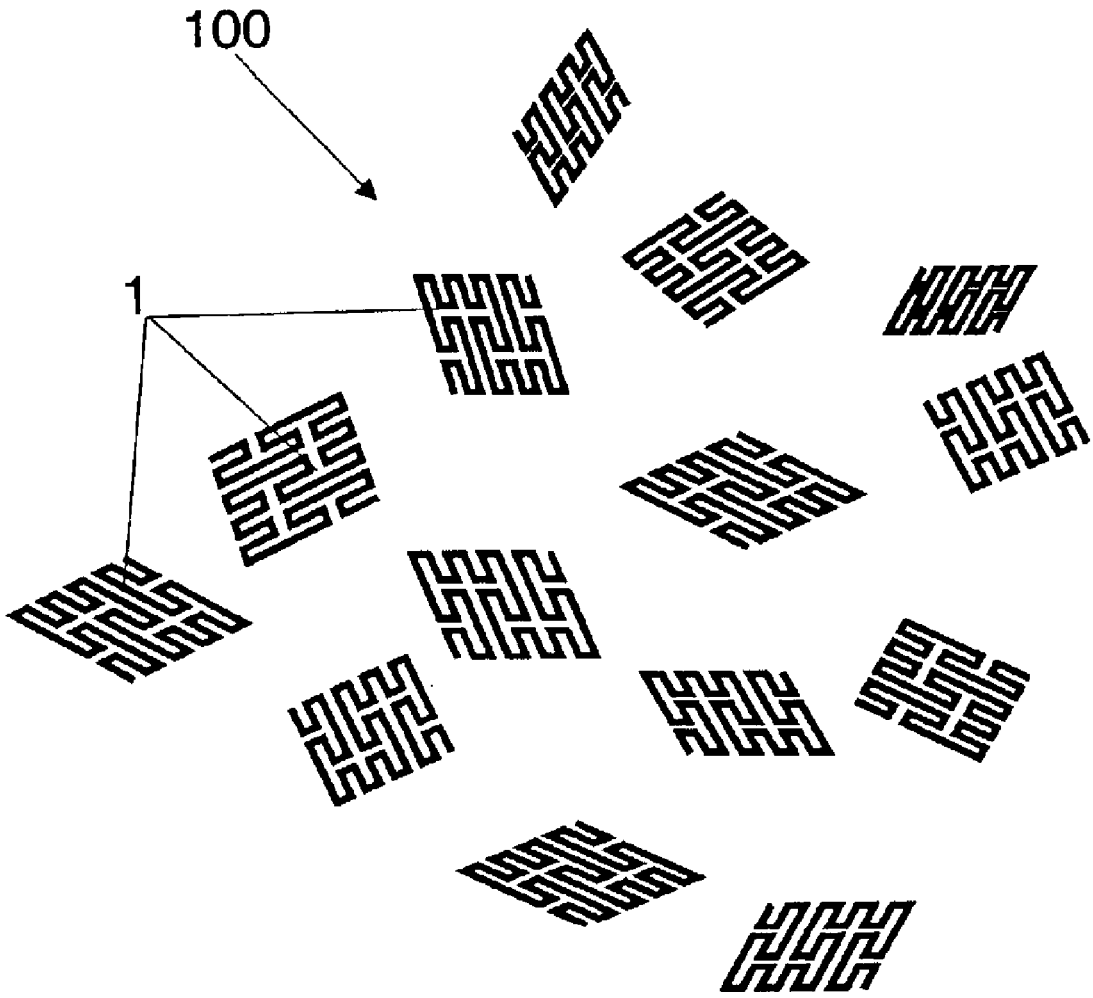
FIG. 15 shows some space-filling dispersers forming a cloud of radar chaff in accordance with the present invention.
Figure 16:
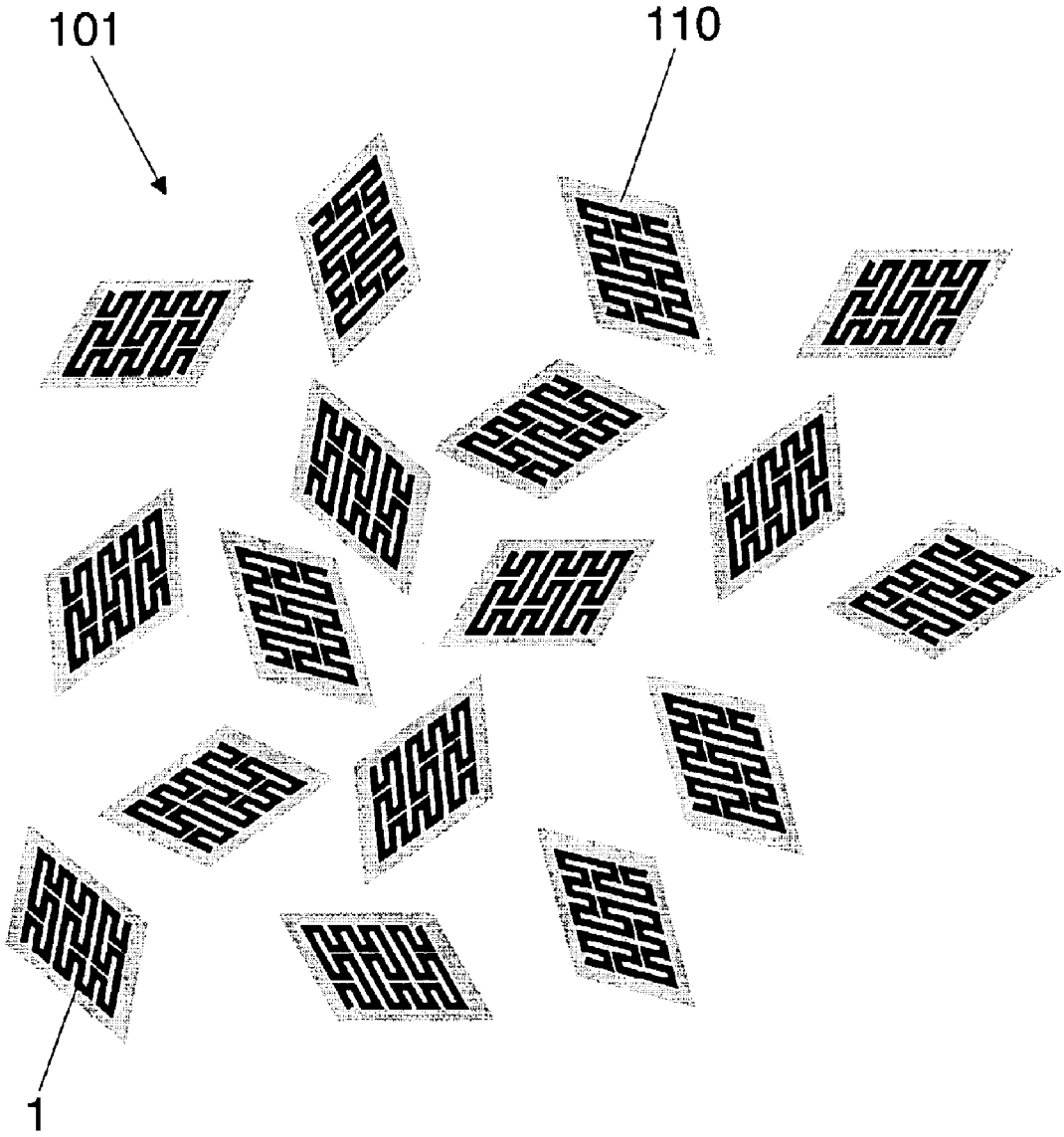
FIG. 16 shows some space-filling dispersers forming a chaff cloud. The dispersers are formed by a conducting, superconducting or semiconducting material configuring a space-filling curve being supported by a leaf of dielectric material.

In accordance with the manufacturing techniques for multilevel and space-filling chaff, many of these techniques are employed. For example, the space-filling and multilevel geometries could be cut and stamped in fine aluminum foil, copper or brass sheets. An example of chaff cloud constructed with this technique is shown in FIG. 15. Alternatively, use can also be made of any of the techniques available relating to printed circuits, be they rigid of flexible, printing and shielding a conductor pattern on a thin dielectric substrate. Said substrate can be made from a material offering low losses at a particular radar frequency, for example polyester, polyamide, paper, MYLAR (a trademark of E.I. DuPont DeNemours and Company identifying a substrate material), fibreglass, TEFLON (a trademark of E.I. DuPont DeNemours and Co. identifying a substrate material), nylon, Dacron, orlon, rayon, KAPTON (a trademark of E.I. DuPont DeNemours and Co. identifying a substrate material), CUCLAD (a trademark of the Minnesota Mining & Manufacturing Comnany identifying a substrate material), substrate materials manufactured by the Rogers Corporation, or substrate materials manufactured by Arlon, Inc. A particular example of chaff cloud (101) wherein the space-filling forms are supported on dielectric material (110) is shown in FIG. 16.

Figure 20:
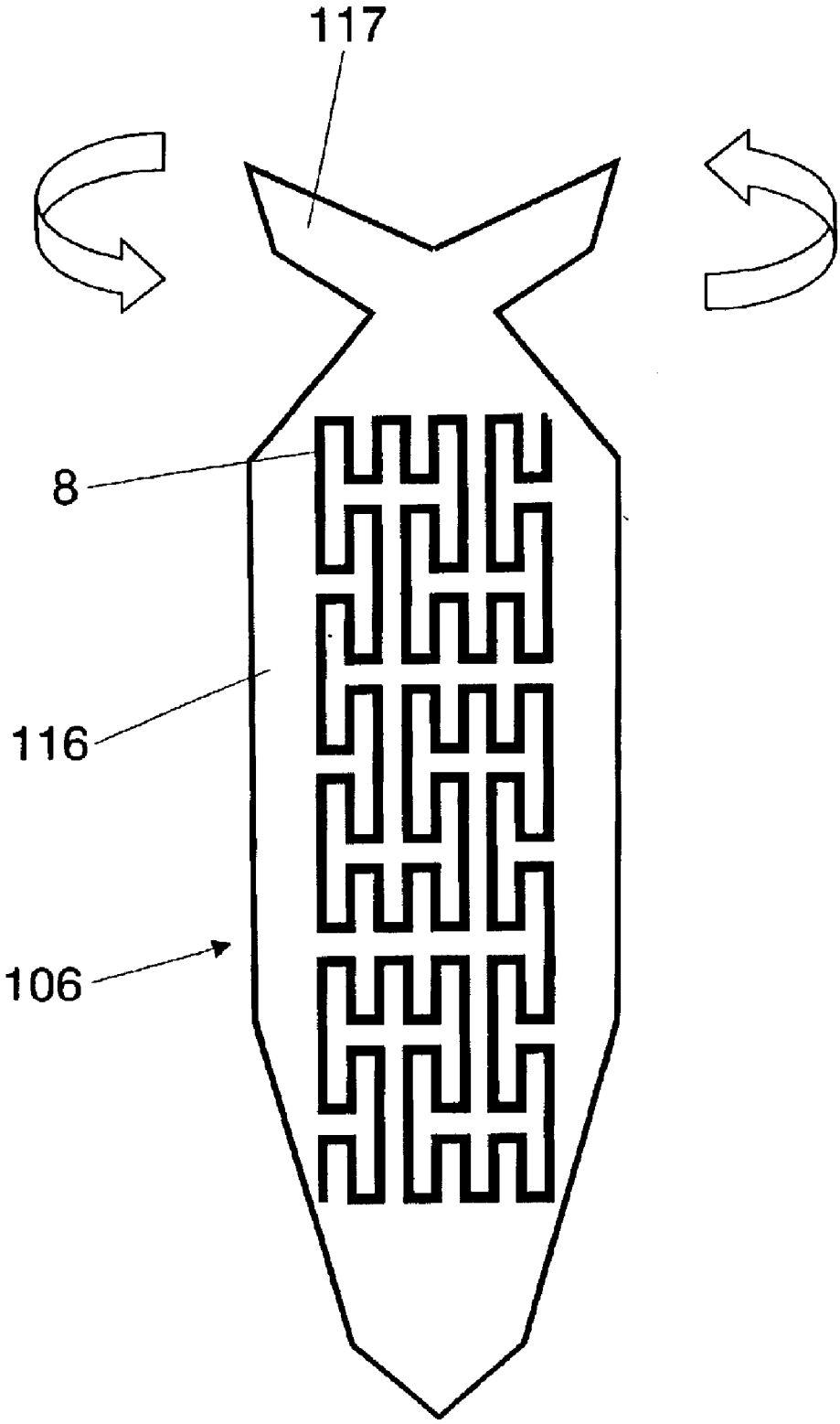
FIG. 20 shows a particular encapsulation of dispersers in which a space-filling curve with an elongated form is chosen to fall in a preferred vertical direction.

The use of a substrate to support the conducting disperser can be convenient in many cases for diverse reasons: it provides additional air friction whereby the chaff remains in suspension a longer time, it prevents many dispersers from becoming intertwined and it can even be used to provide the disperser with a certain resistance to advance. An example of this can be seen in FIG. 20. An arrow is shown as dielectric support so that the disperser adopts the desired orientation when descending. This can be used to improve the polarization state for the signal of the disperser since once the orientation is known with respect to the ground, the form of the disperser can be chosen to provide a greater response for a vertical, horizontal, circular polarization of the particular incident field). Also, for example, it is possible to introduce a packaging technique, (for example in wings (117) on arrow (116)) so that the disperser rotates as it falls toward the ground, introducing in this case an enhanced Doppler response which helps to foil the sensitive Doppler radar sensors.

Figure 22:
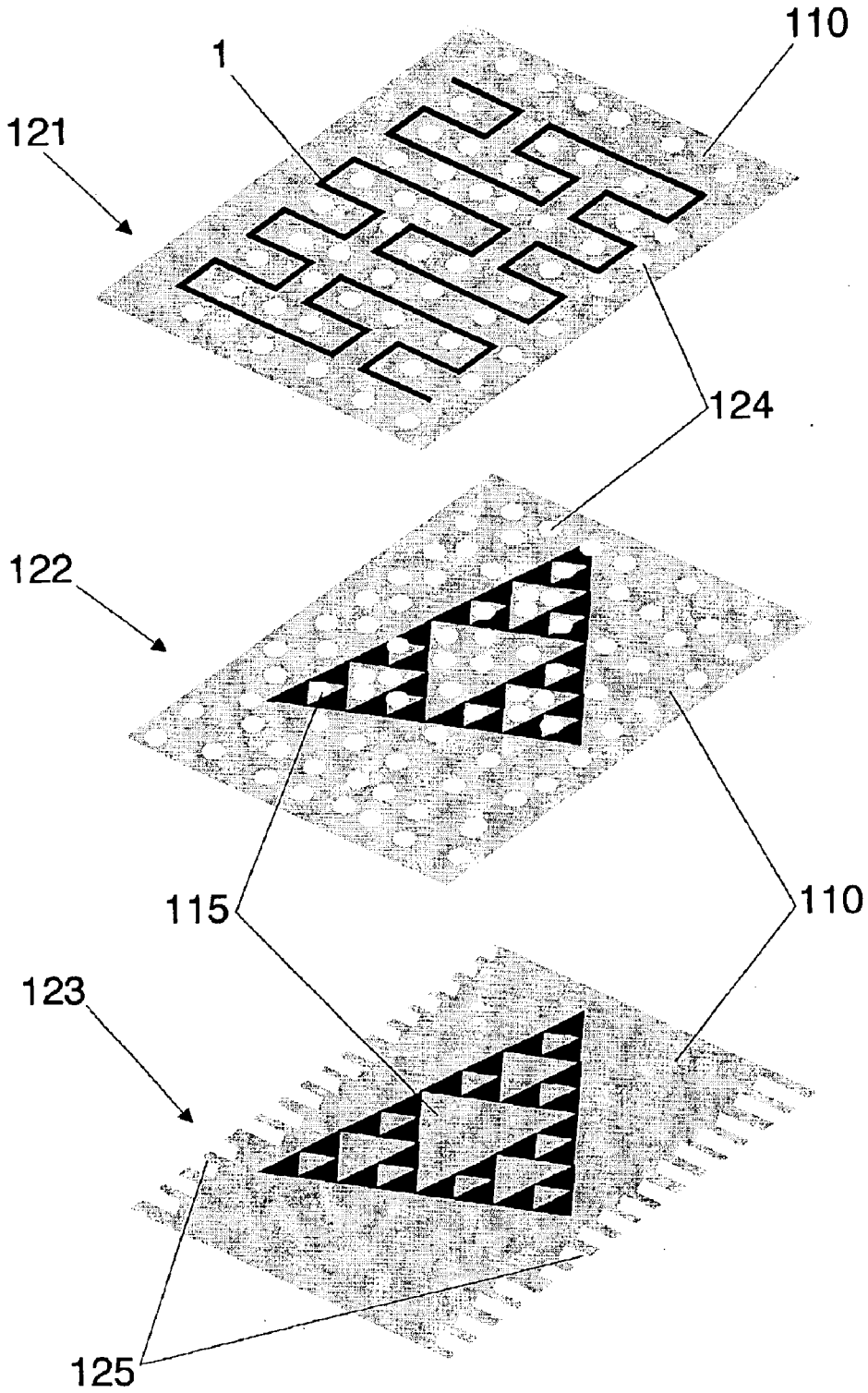
FIG. 22 shows diverse encapsulations wherein a space-filling disperser and a multilevel disperser are supported by a dielectric leaf

Another technique (FIG. 22) to improve air friction and so increase the time of suspension consists in making holes (124) in dielectric substrate (110) so that turbulence is created when the air flows through said holes. Also for the same purpose, the dielectric support can be moulded in a mould material in the shape of a feather with several cuts (125) around the perimeter of said support. This technique is specially convenient when the disperser is supported by a dielectric leaf. Since the leaf covers the whole structure of the disperser, the holes can be made in the spaces that are present between the conducting parts of the space-filling and multilevel dispersers and also the aerodynamic behaviour of the original space-filling or multilevel geometry is recovered.

Another encapsulation for the present invention consists in printing said space-filling and multilevel patterns by means of conducting ink on a fine and light dielectric support like for example paper. For this purpose use can be made of a recyclable, bio-degradable or soluble paper, as well as plastic or a dielectric support. The benefits which could be obtained from this particular configuration could be the extremely cheap procedures for manufacturing said chaff, together with a minimum weight, a maximum packaging ratio and maximum respect for the environment. Also, the decomposition properties of the material in the short and long term would provide convenient evanescent characteristics which can be of interest in multiple environments.

A possible procedure for the production of the dispersers in accordance with the present invention would consist in braiding conducting fibres, or meshed conducting fibres in the form of a space-filling or multilevel curve in a light fabric (like for example wool, cotton, silk or linen) paper or another low-loss dielectric material. Also, a chaff which appears and disappears can be obtained using any of the methods described in the literature like for example by applying on fibreglass or plastic like polyethylene terephalate separate meshes or coats of reducible metallic salt and an oxidizable metal; and by applying afterwards a liquid solution or a spray which contains a chemical which first oxidizes the metallic mesh and thereafter reduces the mesh which contains the reduced metallic salt.

Figure 21:
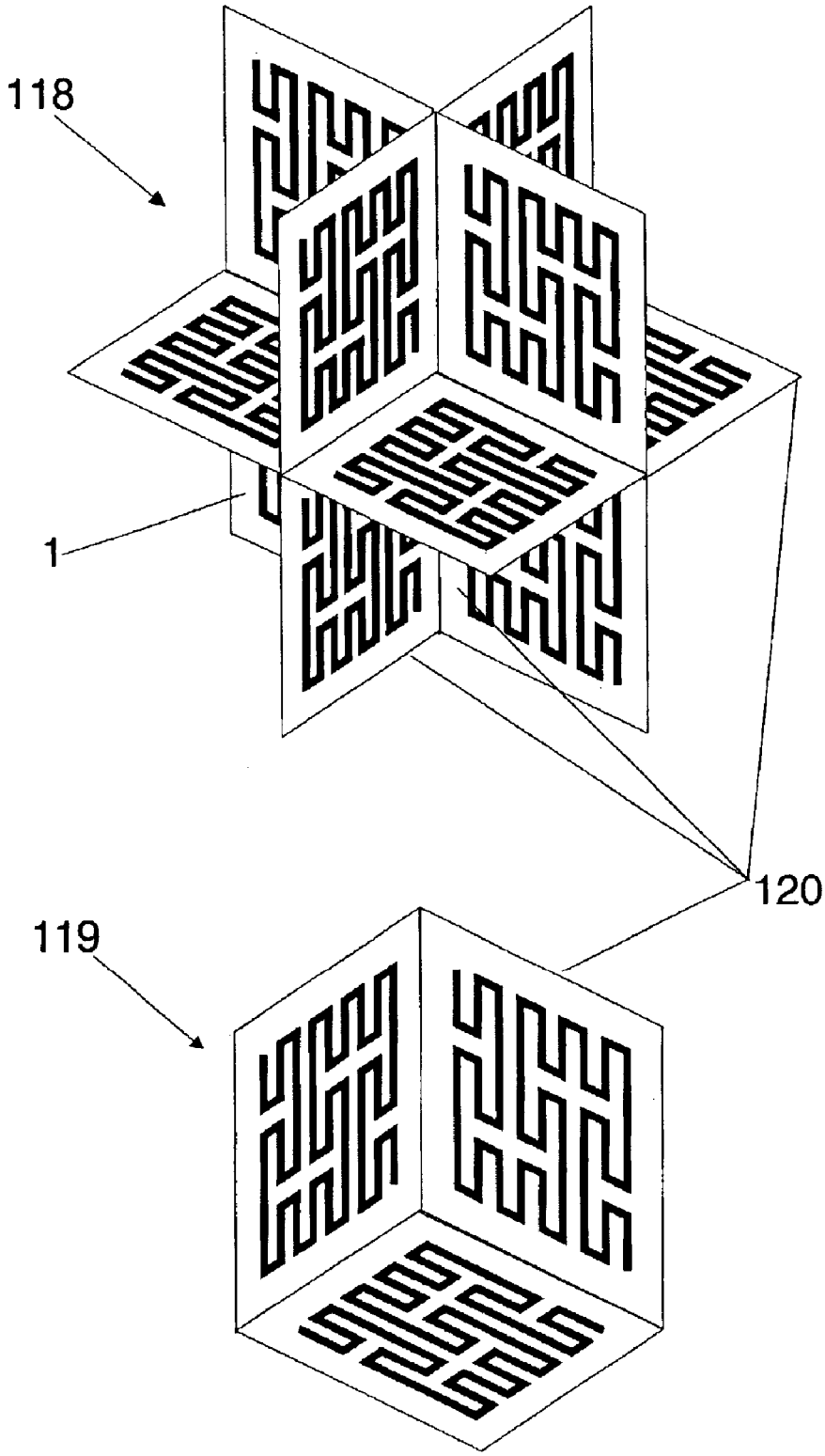
FIG. 21 shows a trihedron reflector with a space-filling disperser on each side of the trihedron.

It is known that trihedral forms improve the backward reflection of incident waves and rays. Any of the preceding encapsulations can be used to arrange the dispersers spatially in the form of multilevel or space-filling trihedrons or compositions of trihedrons. Two particular examples of said encapsulations are shown (with no intention of limitation), in drawings (118) and (119) in FIG. 21. In (119) a trihedron is formed with three space-filling dispersers on each of the three sides. In (118), eight trihedrons are joined to cover each of the eight semi-spaces in a system of Cartesian coordinates. The benefit offered by the combination of the known trihedral forms with the new space-filling and multilevel structures presented for radar chaff dispersers is that said trihedrons are smaller and lighter with respect to the state of the art, although providing the same RCS and a broader range of operating frequency bands.

Other materials can be used to manufacture the chaff in accordance with the present invention. For example, an inhibited radar chaff can be implemented applying a diazo fluoride mesh consisting of a filament coated with sodium silicate, so that said chaff is more sensitive to ultraviolet light. Thus, in a prolonged exposure to light, chaff would become non-conducting and unable to transmit reflections toward the radar set. In this sense, radar chaff would become disabled as a reflector device for long exposure to sunlight or to an artificial ultraviolet light source.

Experts in the art will noticed that the essence of the present invention is based on the geometry of the dispersers.

Many techniques of configuration and production can be used for the present invention in a complementary way. The new geometries presented for a fractal chaff even provide a way to develop chaff dispersers in the form of micro-particles at radar frequencies or laser radar beyond millimetric bands, namely at infrared or optic and ultra-optic laser wavelengths.

What is claimed is:

1. An anti-radar chaff disperser for forming a cloud of defensive countermeasures against radar, comprising, a structure with conducting, semiconducting or superconducting material, said structure being characterised in that at least a part thereof is a space-filling curve, said space-filling curve being composed of at least ten segments connected so that each segment forms an angle with any adjacent segment and said segments being smaller than a tenth part of the resonant wavelength in free space of the whole structure.

2. An anti-radar chaff disperser according to claim 1, characterised in that at least a portion of said space-filling curve has a box-counting dimension grater than unity, said box-counting dimension being calculated as the gradient of a straight portion of a log-log graph, wherein said straight portion is substantially defines by a straight segment over at least an octave on the horizontal axis of the log-log graph.

3. An anti-radar chaff disperser according to claim 1, characterised in that at least a portion of the disperer is formed by a Hilbert or Peano curve.

4. An anti-radar chaff disperser according to claim 1, characterised in that at least a portion of the disperser is formed as a SZ, ZZ, HilbertZZ, Peanoinc, Peanodec, PeanoZZ or a meander curve.

5. An anti-radar chaff disperser for forming a cloud of defensive countermeasures against radar, comprising:

a conducting, semiconducting or superconducting structure, characterised in that at least a portion thereof is a multilevel structure, said multilevel structure including a set of polygons with the same number of sides and which are electromagnetically coupled either by means of capacitive coupling or ohmic contact, wherein a contact region between directly connected polygons is smaller than 50% of the perimeter of said polygons in at least 75% of said polygons defining said portion of said disperser, and wherein a global geometry of the multilevel structure is different than the geometry of each polygon from which it is formed.

6. An anti-radar chaff disperser according to claim 1, 2, 3, 4 or 5, characterised in that the structure of said disperser is formed by a conducting leaf.

7. An anti-radar chaff disperser according to claim 1, 2, 3, 4 or 5, characterised in that the structure of said disperser is made of conducting material, said material being sustained by a light and thin dielectric substrate on at least one of the two faces of said structure.

8. An anti-radar chaff disperser according to claim 7, characterised in that said conducting structure is printed, laminated or deposited on a thin layer of dielectric material.

9. An anti-radar chaff disperser according to claim 1, 2, 3, 4 or 5, characterised in that the structure of said disperser is made of conducting ink, said ink being printed and deposited on a thin dielectric substrate.

10. An anti-radar chaff disperser according to claim 1, 2, 3, 4, 5 or 8, characterised in that the maximum size of the conducting, superconducting or semiconducting structure is smaller than a fourth part of the radar wavelength in free space.

11. An anti-radar chaff disperser according to claim 1, 2, 3, 4, 5 or 8, characterised in that the disperser resonates at multiple frequencies inside the bandwidth of one or several frequency bands in which a radar set operates: HF, UHF, L, S, C, X, Ku, K, Ka or mm.

12. An anti-radar chaff disperser according to claim 1, 2, 3, 4, 5 or 8, characterised in that the disperser resonates at a plurality of frequencies spaced non-harmonically.

13. An anti-radar chaff disperser according to claim 1, 2, 3, 4, 5 or 8, characterised in that the disperser resonates simultaneously with a substantially similar Q-factor at two or more of the following bands: L, S, C, X, Ku, Ka, mm.

14. An anti-radar chaff disperser according to claim 1, 2, 3, 4, 5 or 8, characterised in that the disperser comprises at least three planar surfaces, said surfaces defining a trihedron and said surfaces including a space-filling and multilevel reflector.

15. An anti-radar chaff disperser according to claim 14, characterised in that the disperser includes eight trihedrons, all the trihedrons being oriented in one or eight semi-spaces in a reference of Cartesian coordinates.

16. An anti-radar chaff disperser according to claim 1, 2, 3, 4, 5 or 8, characterised in that the cloud provides a larger radar cross-section with respect to a chaff cloud which includes the same number of dispersers in non-space-filling and non-multilevel form, both clouds operating at the same frequency.

17. An anti-radar chaff disperser according to claim 1, 2, 3, 4, 5 or 8, characterised in that the cloud remains in suspension in the air a longer time with respect to a chaff cloud which includes the same number of dispersers in non-space-filling and non-multilevel form, both clouds operating at the same frequency.

18. An anti-radar chaff disperser according to claim 1, 2, 3, 4, 5 or 8, characterised in that the cloud is composed by a mix of different multilevel and space-filling dispersers of different size, resonate at a different set of frequencies in the radar frequency bands, each set of frequencies being determined by the size of said dispersers and the size of the segments and polygons which constitute the dispersers.

19. An anti-radar chaff disperser according to claim 1, 2, 3, 4, 5 or 8, characterised in that the disperser has a multilevel structure of which at least a part of its external perimeter adopts a space-filling form.

20. An anti-radar chaff disperser according to claim 1, 2, 3, 4, 5 or 8, characterised in that the disperser has a multilevel structure wherein at least a part of the internal openings of the structure adopts a space-filling form.

21. An anti-radar chaff disperser according to claim 1, 2, 3, 4, 5 or 8, characterised in that the support on which the conducting element is mounted has a plurality of holes for creating turbulence in the air which passes through them in order to increase the time of suspension.

22. An anti-radar chaff disperser according to claim 1, 2, 3, 4, 5 or 8, characterised in that the support on which the conducting element is mounted has a series of cuts in its perimeter which contribute to increasing the time of permanency in the air of the reflector.

* * * * *

UNITED STATES PATENT AND TRADEMARK OFFICE

CERTIFICATE OF CORRECTION

PATENT NO. : 6,876,320 B2
DATED : April 5, 2005
INVENTOR(S) : Carles Puente Baliarda It is certified that error appears in the above-identified patent and that said Letters Patent is hereby corrected as shown below:

Column 9,
Line 21, delete “grater” insert -- greater --.
Line 27, delete “disperer” insert -- disperser --.
Lines 48, 51, 59 and 63, delete “claim” insert -- claims --.

Column 10,
Lines 4, 9 and 12, delete “claim” insert -- claims --.

Signed and Sealed this

Ninth Day of August, 2005

JON W. DUDAS
*Director of the United States Patent and Trademark Office*